US006475305B1

(12) United States Patent
Watari et al.

(10) Patent No.: US 6,475,305 B1
(45) Date of Patent: Nov. 5, 2002

(54) MACHINE STRUCTURAL STEEL PRODUCT

(75) Inventors: Koji Watari, Kobe (JP); Yasutaka Okada, Nara (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 0 days.

(21) Appl. No.: 09/669,552

(22) Filed: Sep. 26, 2000

Related U.S. Application Data

(63) Continuation of application No. PCT/JP00/00369, filed on Jan. 25, 2000.

(30) Foreign Application Priority Data

Jan. 28, 1999 (JP) ..... 11-019888
Nov. 24, 1999 (JP) ..... 11-333127

(51) Int. Cl.[7] ..... C22C 38/04; C22C 38/02; C22C 38/06

(52) U.S. Cl. ..... 148/320; 148/330; 148/333; 148/334; 148/335; 148/336; 420/8; 420/84; 420/87

(58) Field of Search ..... 420/8, 84, 87; 148/320, 330, 333, 334, 335, 336

(56) References Cited

FOREIGN PATENT DOCUMENTS

| | | | |
|---|---|---|---|
| EP | 0666332 A | | 8/1995 |
| EP | 0903418 A | | 3/1999 |
| EP | 0969112 A | | 1/2000 |
| JP | 06-212348 | | 8/1994 |
| JP | 406212348 A | * | 8/1994 |
| JP | 08-253842 A | | 10/1996 |
| JP | 08-311615 | | 11/1996 |
| JP | 09-025539 | | 1/1997 |
| JP | 09-049016 | | 2/1997 |
| JP | 09-049067 | | 2/1997 |
| JP | 09-194999 | | 7/1997 |
| JP | 09-202919 A | | 8/1997 |
| JP | 09-324241 | | 12/1997 |
| JP | 10-140281 A | | 5/1998 |
| JP | 10-219393 | | 8/1998 |
| JP | 411152546 A | * | 6/1999 |
| WO | 98/23784 | | 6/1998 |
| WO | 98/32889 A | | 7/1998 |
| WO | 00/44953 | | 8/2000 |

OTHER PUBLICATIONS

European Search Report dated Dec. 21, 2001 for Application No. 00900930.9–2309–JP0000369.

* cited by examiner

*Primary Examiner*—Deborah Yee
(74) *Attorney, Agent, or Firm*—Burns, Doane, Swecker & Mathis, LLP

(57) ABSTRACT

The present invention is directed to a steel product for machine structural use having excellent machinability and to a structural steel part for machinery manufactured from the steel product. More particularly, the invention is directed to a steel product for machine structural use having excellent machinability, particularly bringing about excellent "drill life" and exhibiting excellent "chip disposability" in the course of drilling, as well as to a structural steel part for machinery manufactured from the steel product. The steel product for machine structural use has a chemical composition comprising, in mass percent, C: 0.05% to 0.55%; Si: 0.50% to 2.5%; Mn: 0.01% to 2.00%; P: not greater than 0.035%; S: 0.005% to 0.2%; N: not greater than 0.0150%; elements to be added as needed: Cu, Ni, Cr, Mo, V, Nb, Ti, B, Al, Bi, Ca, Pb, Te, Nd, and Se; $-23C+Si(5-2Si)-4Mn+104S-3Cr-9V+10 \geqq 0$; $3.2C+0.8Mn+5.2S+0.5Cr-120N+2.6Pb+4.1Bi-0.001\alpha^2+0.13\alpha \geqq 3.0$; and balance: Fe and incidental impurities; percentage of ferrite in microstructure being 10% to 80%; and Hv hardness being 160 to 350. In the above expressions, $\alpha$ represents the area percentage in % of a ferrite phase in the microstructure. The structural steel part for machinery can be manufactured relatively easily from the steel product for machine structural use through machining.

12 Claims, 6 Drawing Sheets

MACHINE STRUCTURAL STEEL PRODUCT

This application is a continuation of international application PCT/JP00/00369 filed on Jan. 25, 2000, the entire content of which is herein incorporated by reference.

FIELD OF THE INVENTION

The present invention relates to a steel product for machine structural use having excellent machinability, and to a structural steel part for machinery manufactured from the steel product. More particularly, the invention relates to a steel product for machine structural use having excellent machinability, particularly bringing about excellent "drill life" and exhibiting excellent "chip disposability" in the course of drilling, as well as to a structural steel part for machinery manufactured from the steel product.

BACKGROUND OF THE INVENTION

In the manufacture of various structural steel parts for machinery, a steel product is roughly formed into a predetermined shape through hot working, such as hot forging, and is then finished into a desired shape through machining. The thus-finished parts may be used in a non-heat-treated state or after being subjected to heat treatment, such as normalizing, normalizing-tempering, or quenching-tempering. Alternatively, a steel product may undergo heat treatment after being subjected to hot working, and may then be finished to a desired shape through machining. Before use, some parts may undergo surface hardening, such as carburizing, nitriding, or induction hardening, serving as a final treatment.

Steels having excellent machinability are classified, according to a machinability-enhancing element(s) added, into S (sulfur) type, Pb (lead) type, S—Pb type, Ca type, S—Pb—Ca type, Ti type, and graphite type. In many cases, among these free-cutting steels, a resulfurized free-cutting steel, a leaded free-cutting steel, and a calcium deoxidized steel are employed in structural applications for machinery that requires hard structural steel parts serving as final products. Since machinability of steel deteriorates with hardness, machinability is improved through addition of a large amount of one or more machinability-enhancing element(s), such as Pb, S, or Ca.

However, addition of a large amount of Pb, S, or Ca may cause occurrence of a defect in structural steel parts for machinery, or final products. For example, addition of a large amount of Pb, S, or Ca causes coarsening of inclusions; hence, surface hardening, such as induction hardening or carburizing, may involve occurrence of quenching cracks, which may remain in final products.

Addition of a large amount of Pb, S, or Ca to steel inevitably involves impairment in toughness. Thus, the above-mentioned conventionally popular free-cutting steels may be employed as steel stock without any problem in manufacture of structural steel parts for machinery requiring only moderate toughness, such as crank-shafts, connecting rods, and printer shafts, but may encounter difficulty in obtaining a desired high toughness in manufacture of structural steel parts for machinery requiring high toughness, such as wheel hubs, spindles, knuckle arms, and torque arms. For example, in manufacture of high-hardness structural steel parts for machinery requiring a Vickers hardness of not less than 160, the above-mentioned free-cutting steels to be employed contain a large amount of S so as to enhance machinability, and a large amount of Pb so as to enhance chip disposability. As a result, anisotropy of toughness increases, and toughness itself is impaired significantly.

As one measure to cope with this problem, PCT Pub. No. WO98/23784 discloses a free-cutting steel product for machine structural use, which contains Ti in an amount of 0.04 to 1.0% by mass in the form of a finely dispersed Ti carbosulfide to thereby exhibit excellent machinability. The free-cutting steel product proposed in this publication can suppress occurrence of a defect in final products, which would otherwise result from coarsening of inclusions, and can impart favorably balanced hardness and toughness to structural steel parts for machinery. However, industrial demands for enhancement of machinability are growing further. Recently, a further increase in cutting speed has been sought in order to further reduce cutting cycle times in automated production lines. In order to meet these demands, there has been demand for steel products for machine structural use surpassing the proposed steel product in machinability.

Japanese Patent Application Laid-Open (kokai) No. 49067/1997 discloses a new technique for enhancement of machinability; specifically, "steel for plastic mold" having an increased Si content. However, when employed as steel stock in manufacture of structural steel parts for machinery, the proposed "steel for plastic mold" fails to provide stable chip disposability required in cutting of parts in an automated mass production line, as in cutting of automobile parts, such as connecting rods and gears. Since molds are machined individually while in an open state, chip disposability does not raise any problem in machining thereof. Accordingly, the invention of the proposed "steel for plastic mold" does not take chip disposability into consideration.

SUMMARY OF THE INVENTION

An object of the present invention is to provide a steel product for machine structural use having excellent machinability; specifically, bringing about excellent "drill life" and exhibiting excellent "chip disposability" in the course of drilling therein a so-called "deep hole" having a (hole depth)/(hole diameter) ratio of not less than 5 by use of a drill made of a conventional Co-containing high-speed steel (a so-called "high-speed steel drill"), as well as to provide a structural steel part for machinery manufactured from the steel product. Herein, a steel product for machine structural use and a structural steel part for machinery of the present invention have a target Vickers hardness (hereinafter called Hv hardness) of 160 to 350 and bring about a "drill life" of not less than 150 drilled holes. Specific examples of structural steel parts for machinery that must have these characteristics include crank-shafts, connecting rods, and printer shafts.

Another object of the present invention is to provide a steel product for machine structural use exhibiting an absorbed energy at room temperature ($_{U}E_{RT}$) of not less than 40J as measured in an impact test conducted by use of a No. 3 test piece for a Charpy impact test specified in JIS Z 2202 as well as having an Hv hardness of 160 to 350 mentioned above and machinability mentioned above in terms of "drill life" and "chip disposability," as well as to provide a structural steel part for machinery manufactured from the steel product. Examples of structural steel parts for machinery that must have these characteristics include wheel hubs, spindles, knuckle arms, and torque arms.

Notably, an Hv hardness of 160 to 350 corresponds to a tensile strength of about 520 to 1100 MPa.

The gist of the present invention is as follows:

A steel product for machine structural use having a chemical composition comprising, in mass percent, C:

0.05% to 0.55%; Si: 0.50% to 2.5%; Mn: 0.01% to 2.00%; P: not greater than 0.035%; S: 0.005% to 0.2%; Cu: 0% to 1.5%; Ni: 0% to 2.0%; Cr: 0% to 2.0%; Mo: 0% to 1.5%; V: 0% to 0.50%; Nb: 0% to 0.1%; Ti: 0% to less than 0.04%; B: 0% to 0.01%; Al: not greater than 0.04%; N: not greater than 0.015%; Bi: 0% to 0.10%; Ca: 0% to 0.05%; Pb: 0% to 0.12%; Te: 0% to 0.05%; Nd: 0% to 0.05%; Se: 0% to 0.5%; value of fn1 represented by equation (1) below: not less than 0; value of fn2 represented by equation (2) below: not less than 3.0; and balance: Fe and incidental impurities; an area percentage of a ferrite phase in a microstructure being 10% to 80%; and Hv hardness being 160 to 350;

$$fn1=-23C+Si(5-2Si)-4Mn+104S-3Cr-9V+10 \quad (1)$$

$$fn2=3.2C+0.8Mn+5.2S+0.5Cr-120N+2.6Pb+4.1Bi-0.0\alpha^2+0.13\alpha \quad (2)$$

where an element symbol appearing in equation (1) or (2) represents the content in mass percent of the corresponding element, and a represents the area percentage in % of the ferrite phase in the microstructure.

Preferably, in order to obtain sufficient toughness, in the above-mentioned chemical composition of the steel product for machine structural use, the S content, in mass percent, is 0.005% to 0.080%, and the value of fn3 represented by equation (3) below is not greater than 100.

$$fn3=100C+11Si+18Mn+32Cr+45Mo+6V \quad (3)$$

where an element symbol appearing in equation (3) represents the content in mass percent of the corresponding element.

Preferably, in the above-mentioned chemical composition of the steel product for machine structural use, the S content in mass percent is 0.005% to 0.080%; the value of fn3 represented by equation (3) is not greater than 100; and the value of fn4 represented by equation (4) below is not less than 5.0, thereby imparting sufficient toughness to a structural steel part for machinery. In this case, structural steel parts for machinery formed from the steel product through hot forging can be free from occurrence of a defect which would result in rejection thereof as defective articles in nondestructive testing, such as ultrasonic testing or magnetic particle testing. Furthermore, when the structural steel parts for machinery are subjected to surface hardening serving as a final treatment, such as carburizing or induction hardening, cracking of the structural steel parts can be prevented.

$$fn4=n_1/n_2 \quad (4)$$

where $n_1$ represents the number of inclusions having a maximum diameter of 0.5 $\mu$m to 3 $\mu$m, and $n_2$ represents the number of inclusions having a maximum diameter in excess of 3 $\mu$mm as observed in a longitudinal section of the steel product.

Preferably, in order to enable structural steel parts for machinery to bring about longer drill life, in the above-mentioned chemical composition of the steel product for machine structural use, the Mn content in mass percent is 0.15% to 2.00%; the S content in mass percent is in excess of 0.080% and not greater than 0.2%; and the value of fn1 represented by equation (1) is not less than 7.5.

Drilling conditions are as mentioned previously; specifically, a so-called "deep hole" having a (hole depth)/(hole diameter) ratio of not less than 5 is drilled by use of a conventional Co-containing high-speed steel drill. The above-mentioned "hole" may be a so-called "blind hole," which does not extend through the object of drilling along a drilling direction, or may be a "through-hole," which extends through the object of drilling.

When a single hole is drilled, chips other than a chip which is ejected from a drill tip immediately after start of drilling break in various shapes. Fn2 represented by equation (2) serves as the "index of chip disposability" indicative of "chip disposability". FIG. 1 shows the relationship between the value of fn2 and the state of breakage of chips. Values of fn2 equal to or less than 0 are all defined as "0".

The area percentage in microstructure is obtained through microscopic observation.

In the present invention, the "longitudinal section" (hereinafter, called an "L-section") of a steel product denotes a section of the steel product taken along a centerline of the same in parallel with a machining direction. The "maximum diameter" of an inclusion denotes a diameter as measured across "the widest portion of an inclusion on an L-section."

DETAILED DESCRIPTION OF THE INVENTION

Figure 1:
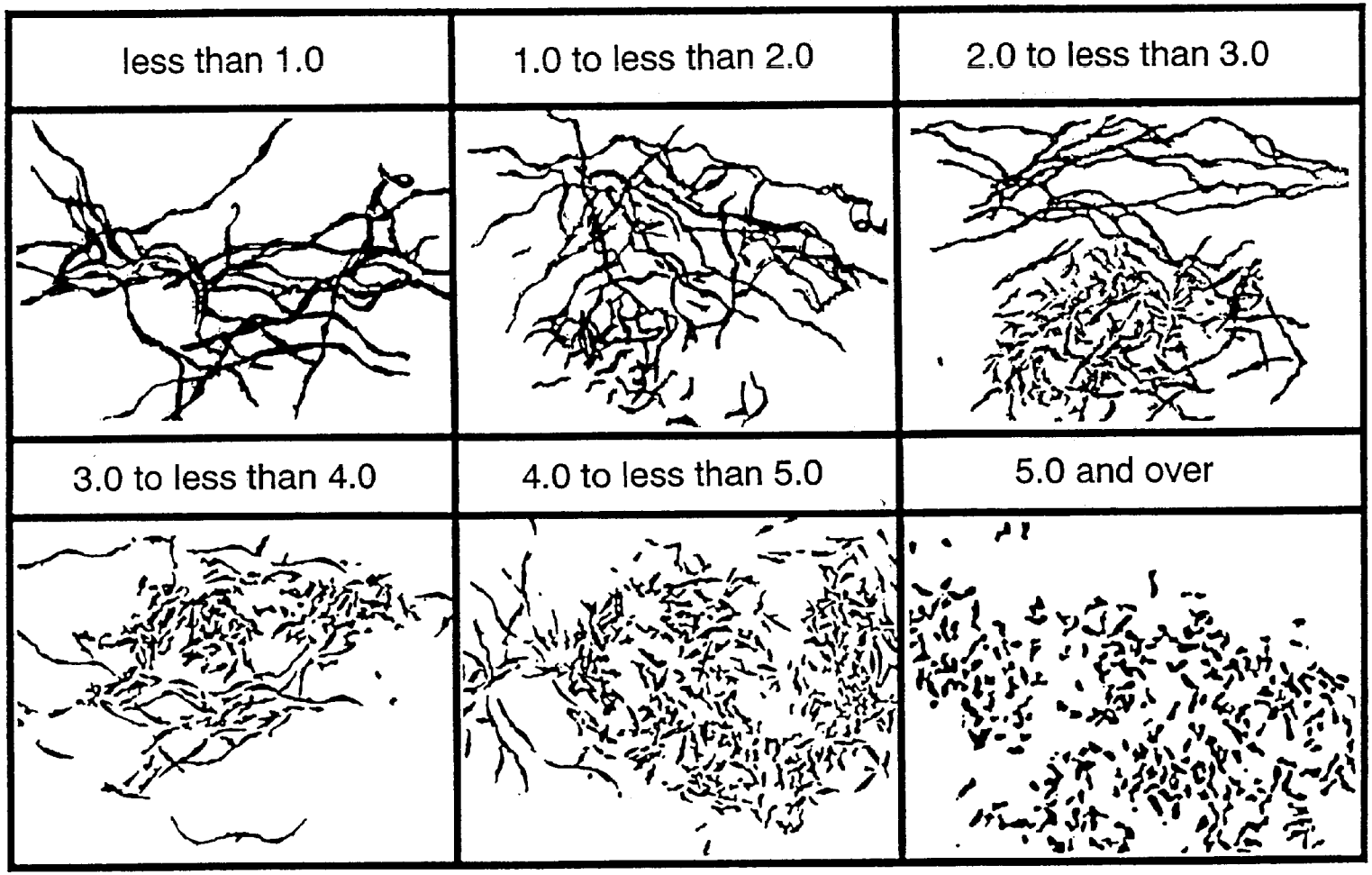
FIG. 1 is a view showing the relationship between the value of the "index of chip disposability" fn2 indicative of "chip disposability" and represented by equation (2) and the state of breakage of chips.

The present inventors have examined and studied the effects of chemical compositions and microstructures of steel products on machinability of the same as well as on hardness and toughness, which serve as parameters of machinability and mechanical performance.

As a result, the inventors have obtained the following findings:

(a) Through control of the area percentage of the ferrite phase in the microstructure of a steel product, there can be enhanced machinability, specifically drillability, more particularly chip disposability. In the description below, the "ferrite phase" is called merely "ferrite." The "area percentage" may be called merely "percentage."

(b) Through employment of an fn1 value of not less than 0 as calculated by equation (1), when a so-called "deep hole" having a (hole depth)/(hole diameter) ratio of not less than 5 is drilled in a structural steel part for machinery having a high HV hardness of 160 to 350 by use of a conventional Co-containing high-speed steel drill, a "drill life" of not less than 150 drilled holes can be attained.

(c) Through employment of an fn1 value of not less than 7.5, the number of drilled holes mentioned above in (b) can be increased to 300 or more. Accordingly, an increase in S content is effective for those structural steel parts for machinery, such as crank-shafts, to which drill life in the course of deep-hole drilling is quite important, but toughness is not very important.

(d) Enhancement of "chip disposability" serving as a parameter of machinability stabilizes and extends drill life in drilling, and eliminates the need to dispose of chips, thereby becoming essential for automation of work operations.

(e) In addition to appropriate control of the percentage of ferrite in microstructure, employment of an fn2 value of not less than 3.0 as calculated by equation (2) improves chip disposability in drilling the above-mentioned high-hardness structural steel part for machinery, thereby facilitating disposal of chips. Thus, drill life can be stably extended. Since the need to dispose of chips can be eliminated, work operations can be automated.

(f) Employment of an fn3 value of not greater than 100 as calculated by equation (3) imparts favorable toughness to a structural steel part for machinery having a high Hv hardness of 160 to 350. Specifically, the structural steel part for machinery exhibits an absorbed energy at room temperature ($_UE_{RT}$) of not less than 40J as measured in an impact test conducted by use of a No. 3 test piece for Charpy impact test specified in JIS Z 2202.

(g) Through employment of an fn4 value of not less than 5.0 as calculated by equation (4) in relation to inclusions observed on the L-section of a steel product, structural steel parts for machinery formed from the steel through, for example, hot forging can be free from occurrence of a defect which would result in rejection thereof as defective articles in nondestructive testing, such as ultrasonic testing or magnetic particle testing. Furthermore, when a structural steel part for machinery is subjected to surface hardening serving as a final treatment, such as carburizing or induction hardening, cracking of the structural steel part can be prevented.

The present invention has been accomplished on the basis of the above findings.

Requirements of the present invention will next be described in detail. The symbol "%" indicative of the content of each element means "mass percent."

Chemical Composition of Steel Product

C: 0.05% to 0.55%

C is an element essential to enhancement of hardness of steel so as to impart a desired high hardness to structural steel parts for machinery. Furthermore, addition of C enhances "chip disposability" serving as a parameter of machinability. When the C content is less than 0.05%, these effects are hardly yielded. When the C content is too high, "chip disposability" is saturated or decreases. Furthermore, the amount of tool wear on turning increases; i.e., tool life on turning is shortened. Particularly, when the C content is in excess of 0.55%, parameters of machinability including tool wear on turning are all impaired. Accordingly, the C content is specified as 0.05% to 0.55%.

Si: 0.50% to 2.5%

Si is an element effective in improvement of machinability. An Si content of 0.50% or more yields the effect. However, the machinability improvement effect is saturated when the Si content reaches about 2.0%. When the Si content is in excess of 2.5%, the form of deformation of chips shifts to intermittently shearing deformation, involving a great change in chip thickness. Thus, the tool life is shortened. Accordingly, the Si content is specified as 0.50% to 2.5%. Addition of Si does not contribute much to improvement in hardness; however, addition of a large amount of Si deteriorates toughness. Thus, when steel products for machine structural use which contain a large amount of Si for improving machinability are to be employed as steel stock for parts requiring high toughness, such as wheel hubs, spindles, knuckle arms, and torque arms, attention must be paid to balance between improvement in machinability and maintenance of toughness.

Mn: 0.01% to 2.00%

Addition of Mn enhances hardness and improves toughness. Furthermore, addition of Mn enhances hot workability, through fixation of S contained in steel. However, an Mn content of less than 0.01% fails to yield these effects. By contrast, these effects are saturated when the Mn content reaches about 2.00%. Accordingly, the Mn content is specified as 0.01% to 2.00%.

Preferably, the Mn content is varied in cooperation with the S content, which will be described later, according to required characteristics of structural steel parts for machinery.

Specifically, when structural steel parts for machinery must have high toughness and machinability as in the case of wheel hubs, spindles, knuckle arms, and torque arms, the Mn content is preferably decreased as much as possible so long as a desired hardness can be imparted to the structural steel parts, while the S content is controlled to 0.005% to 0.080%. Specifically, the upper limit of the Mn content is preferably 1.50%, more preferably 1.00%. When the Mn content is decreased, mainly the amount of MnS is decreased, thereby fining and dispersing inclusions and thus preventing cracking when surface hardening is performed as a final treatment.

When structural steel parts for machinery must have very high toughness and machinability, the upper limit of the Mn content is more preferably 0.50% at the above-mentioned S content. When the upper limit of the Mn content is 0.30%, toughness, particularly toughness at low temperature, can be enhanced. Furthermore, machinability is improved, and the amount of MnS inclusions decreases, thereby decreasing the amount of inclusions having a maximum diameter in excess of 3 $\mu$m, and thus further fining and dispersing inclusions.

When structural steel parts for machinery must have good machinability, but are required to have only moderate toughness, the Mn content is preferably not less than 0.15% in order to fix S while the S content is in excess of 0.080% and not greater than 0.2%. More preferably, the lower limit of the Mn content is 0.30%.

P: not greater than 0.035%

Addition of P impairs hot workability. Particularly, when the P content is in excess of 0.035%, hot workability is impaired significantly. Accordingly, the P content is specified as not greater than 0.035%.

S: 0.005% to 0.2%

S, when added, forms MnS in steel to thereby improve machinability, particularly the tool life on turning. However, when the S content is less than 0.005%, this effect is hardly yielded. When the S content is in excess of 0.2%, cracking often occurs in products in the course of surface hardening, such as carburizing or induction hardening, resulting in defective products. Accordingly, the S content is specified as 0.005% to 0.2%.

Preferably, the S content is varied according to required characteristics of structural steel parts for machinery.

Specifically, when structural steel parts for machinery must have high toughness and machinability as in the case of wheel hubs, spindles, knuckle arms, and torque arms, preferably, the fn3 value is not greater than 100, and the S content is 0.005% to 0.080%. This is because, when the S content is in excess of 0.080%, the amount of MnS inclusions having a maximum diameter in excess of 3 $\mu$m as observed on the L-section increases; as a result, anisotropy of toughness becomes conspicuous, or toughness itself may deteriorate in some cases.

Enhancing machinability of high-hardness steel products without involvement of conspicuous anisotropy of toughness requires means for decreasing the maximum diameter of MnS inclusions as observed on the L-section while enhancing machinability. Thus, according to the present invention, the combination of alloy elements and the percentage of ferrite are appropriately controlled. When attainment of toughness is very important, the upper limit of the S content is preferably 0.035%. In this case, through strict control of the combination of alloy elements and the percentage of ferrite, sufficient machinability is attained. When attainment of toughness is far more important, the upper limit of the S content is preferably 0.02%. In this case, for example, the Si content is increased; the Mn content is decreased; and Cr and V are added in the respective appropriate amounts, thereby attaining sufficient machinability.

When structural steel parts for machinery require only moderate toughness but must have good machinability as in the case of crank-shafts, connecting rods, and printer shafts, S is contained preferably in an amount in excess of 0.080%. In this case, the number of drilled holes serving as the "drill life" in the course of drilling deep holes can reliably attain 300 or more.

Cu: 0% to 1.5%

Cu may not be added. Addition of Cu improves hardness. Furthermore, Cu forms a sulfide within a steel, thereby improving machinability. In the case of so-called "soft" structural steel parts for machinery having an Hv hardness of 160 to 280, in order to reliably obtain these effects, the Cu content is preferably not less than 0.02%, more preferably not less than 0.05%. In the case of so-called "hard" structural steel parts for machinery having an Hv hardness in excess of 280 (in the present invention, an Hv hardness in excess of 280 and not greater than 350), in order to reliably obtain these effects, the Cu content is preferably not less than 0.2%. However, when the Cu content is in excess of 1.5%, hot workability decreases significantly. Accordingly, the Cu content is specified as 0% to 1.5%.

Ni: 0% to 2.0%

Ni may not be added. Addition of Ni enhances hardness and toughness. In the case of steel products to be quenched, addition of Ni enhances hardenability. In order to reliably obtain these effects, the Ni content is preferably not less than 0.2%. However, when the Ni content is in excess of 2.0%, these effects are saturated. Furthermore, adhesion of chips to a tool becomes intensive, resulting in shortened tool life. As a result, production costs increase; i.e., economical efficiency is impaired. Accordingly, the Ni content is specified as 0% to 2.0%.

Cr: 0% to 2.0%

Cr may not be added. Addition of Cr enhances hardness. Furthermore, addition of Cr enhances "chip disposability" serving as a parameter of machinability and generates fine inclusions (CrS) in a steel. In order to reliably obtain these effects, the Cr content is preferably not less than 0.2%, more preferably not less than 0.5%. However, when the Cr content is in excess of 2.0%, the percentage of ferrite in microstructure decreases greatly, resulting in significantly decreased "chip disposability." Accordingly, the Cr content is specified as 0% to 2.0%. When the C content is not greater than about 0.25%, the upper limit of the Cr content is preferably 1.5%. When the C content falls within the previously mentioned range having an upper limit of 0.55%, the upper limit of the Cr content is more preferably 1.0%.

Mo: 0% to 1.5%

Mo may not be added. Addition of Mo enhances hardness and toughness. In the case of steel products to be quenched, addition of Mo enhances hardenability. In order to reliably obtain these effects, the Mo content is preferably not less than 0.1%. However, when the Mo content is in excess of 1.5%, these effects are saturated. As a result, production costs increase; i.e., economical efficiency is impaired. Accordingly, the Mo content is specified as 0% to 1.5%.

V: 0% to 0.50%

V may not be added. Addition of V greatly enhances hardness without toughness and drill life being greatly decreased, and suppresses tool wear on turning. In order to reliably obtain these effects, the V content is preferably not less than 0.01%. However, when the V content is in excess of 0.50%, V carbonitrides which have not been "dissolved-in" to form a solid solution are generated, resulting in a failure to contribute to improvement of hardness and causing a great decrease in toughness and machinability. Accordingly, the V content is specified as 0% to 0.50%.

Nb: 0% to 0.1%

Nb may not be added. Addition of Nb fines grains, thereby enhancing toughness, particularly yield strength. In order to reliably obtain these effects, the Nb content is preferably not less than 0.005%. However, when the Nb content is in excess of 0.1%, Nb carbonitrides, which are coarse and hard, remain undissolved, resulting in decreased toughness instead of enhanced toughness and causing a decrease in machinability. Accordingly, the Nb content is specified as 0% to 0.1%.

Ti: 0% to less than 0.04%

Ti may not be added. Addition of Ti forms sulfides of Ti to thereby suppress generation of MnS inclusions, thereby fining and dispersing inclusions. Furthermore, addition of Ti brings about precipitation of carbide to thereby enhance hardness. In order to stably obtain these effects, the Ti content is preferably not less than 0.005%. However, when Ti is added too much, hardness is improved greatly through formation of TiC, potentially resulting in decreased ductility; i.e., a decrease in elongation and reduction of area. Particularly, when the Ti content is not less than 0.04%, ductility may be decreased significantly in some cases. Accordingly, the Ti content is specified as 0% to less than 0.04%.

B: 0% to 0.01%

B may not be added. Addition of B enhances machinability further. In order to reliably obtain this effect, the B content is preferably not less than 0.0010%. However, when the B content is in excess of 0.01%, toughness and hot workability decrease. Accordingly, the B content is specified as 0% to 0.01%.

Al: not greater than 0.04%

Al is an effective element in deoxidation of steel. However, in the present invention, since Si is contained in the previously mentioned amount, deoxidation can be performed through addition of Si. Accordingly, deoxidation through addition of Al is not particularly necessary. Therefore, Al may not be added. Notably, when the Al content is in excess of 0.04%, adhesion of chips to a tool becomes intensive, resulting in shortened tool life on drilling and turning. Accordingly, the Al content is specified as not greater than 0.04%.

When structural steel parts for machinery must have high toughness as in the case of wheel hubs, spindles, knuckle arms, and torque arms, in order to reliably obtain sufficient toughness, the 0 (oxygen) content of a steel is controlled preferably to not greater than 0.015%. Thus, when the contents of C and Si, which yield deoxidation effect, are low, the Al content is preferably not less than 0.010%.

N: not greater than 0.015%

Limitation of the N content is very important. Specifically, addition of N deteriorates "chip disposability." Particularly, when the N content is in excess of 0.015, "chip disposability" decreases significantly. As a result, in spite of addition of another element that improves "chip disposability," "chip disposability" cannot be improved. Accordingly, the N content is specified as not greater than 0.015%. Conventionally, N is added in order to improve hardness of a non-heat treatment type steel. However, as mentioned previously, through appropriate control of the C, Si, Mn, Cr, and V contents, desired hardness can be obtained without intentional addition of N. Thus, the N content is suppressed as low as possible; specifically, to not greater than 0.010%. Particularly, when, through employment of an Hv hardness of not greater than 280, chip disposability is likely to deteriorate, the N content is preferably not greater than 0.006%. However, when the N content is less than 0.002%, chip disposability may deteriorate in some cases. Accordingly, the lower limit of the N content is preferably 0.002%.

Bi: 0% to 0.10%

Bi may not be added. Addition of Bi enhances machinability further. In order to reliably obtain this effect, the Bi content is preferably not less than 0.01%. However, when the Bi content is in excess of 0.10%, toughness and hot workability decrease. Accordingly, the Bi content is specified as 0% to 0.10%.

Ca: 0% to 0.05%

Ca may not be added. Addition of Ca spheroidizes mainly MnS, thereby preventing structural steel parts for machinery formed through, for example, hot forging, from suffering occurrence of a defect which would result in rejection of the same as defective articles in nondestructive testing, or preventing cracking of the structural steel parts upon subjection to surface hardening serving as a final treatment. In order to reliably obtain this effect, the Ca content is preferably not less than 0.001%. However, when the Ca content is in excess of 0.05%, hot workability decreases significantly. Furthermore, in some cases, in the course of carburizing or induction hardening serving as surface hardening, cracking may frequently occur, resulting in defective products. Accordingly, the Ca content is specified as 0% to 0.05%.

Pb: 0% to 0.12%

Pb may not be added. Addition of Pb enhances machinability further. In order to reliably obtain this effect, the Pb content is preferably not less than 0.02%. However, when the Pb content is in excess of 0.12%, hot workability decreases. Furthermore, in some cases, in the course of carburizing or induction hardening serving as surface hardening, cracking may frequently occur, resulting in defective products. Accordingly, the Pb content is specified as 0% to 0.12%.

Te: 0% to 0.05%

Te may not be added. Addition of Te spheroidizes mainly MnS, thereby preventing structural steel parts for machinery formed through, for example, hot forging, from suffering occurrence of a defect which would result in rejection of the same as defective articles in nondestructive testing, or preventing cracking of the structural steel parts upon subjection to surface hardening serving as a final treatment. In order to reliably obtain this effect, the Te content is preferably not less than 0.005%. However, when the Te content is in excess of 0.05%, hot workability decreases significantly. Accordingly, the Te content is specified as 0% to 0.05%.

Nd: 0% to 0.05%

Nd may not be added. Addition of Nd spheroidizes mainly MnS, thereby preventing structural steel parts for machinery formed through, for example, hot forging, from suffering occurrence of a defect which would result in rejection of the same as defective articles in nondestructive testing, or preventing cracking of the structural steel parts upon subjection to surface hardening serving as a final treatment. In order to reliably obtain this effect, the Nd content is preferably not less than 0.005%. However, when the Nd content is in excess of 0.05%, hot workability decreases significantly. Accordingly, the Nd content is specified as 0% to 0.05%.

Se: 0% to 0.5%

Se may not be added. Addition of Se enhances machinability further. In order to reliably obtain this effect, the Se content is preferably not less than 0.05%. However, when the Se content is in excess of 0.5%, toughness and hot workability decrease significantly. Accordingly, the Se content is specified as 0% to 0.5%.

In the present invention, the O (oxygen) content may not be particularly specified. In some cases, when the O content is high, oxides contained in a steel may coarsen, which would be evaluated as defective in ultrasonic testing, resulting in decreased yield. Accordingly, the O content is preferably not greater than 0.015%. When high toughness is required, the O content is particularly preferably not greater than 0.015%.

Some conventional free-cutting steels are put into practical use in the form of so-called "oxide-controlled steel." In order to perform sufficient deoxidation, this "oxide-controlled steel" does not employ control of Si and Al contents. Specifically, an appropriate element such as Ca is added to thereby form composite oxides of, for example, Si, Al, and Ca, and the compositional proportions of these composite oxides are controlled appropriately so as to lower the melting points of the oxides, thereby improving machinability.

By contrast, in order to improve machinability, the steel products for machine structural use and the structural steel parts for machinery according to the present invention do not require utilization of the above-mentioned low-melting-point oxides. Sufficient machinability can be attained even at a high Hv hardness of 160 to 350 through employment of the above-mentioned element contents, control of the values of fn1and fn2 represented by equations (1) and (2) to the respective appropriate ranges, which will next be described in detail, and control of the percentage of ferrite in microstructure to an appropriate range, which will be described later. Accordingly, even when the steel products for machine structural use and the structural steel parts for machinery according to the present invention employ the percentage composition of the above-mentioned "oxide-controlled steel," the attained improvement of machinability is not derived from the contained oxides.

fn1: not less than 0

Machinability, particularly enhancement of drillability, is important for steel products for machine structural use. A so-called "deep hole" having a relatively large ratio of depth to the maximum diameter is drilled in structural steel parts for machinery. A typical example of a "deep hole" is an oil hole. Because of difficulty in using carbide, which has excellent wear resistance, as material for a drill used for drilling a "deep hole," a high-speed steel, which contains Co -and has excellent toughness and wear resistance, is predominantly used. Thus, extension of drill life cannot rely much on improvement of the material for a drill, but relies heavily on drillability of steel products for machine structural use.

In order to improve drillability of steel products for machine structural use, the number of drilled holes serving as the "drill life" and "chip disposability" must be enhanced. The "drill life" depends on hardness and chemical composition of a steel product to be machined. Specifically, the "drill life" decreases with hardness of a steel product to be machined. However, this tendency depends greatly on the chemical composition of the steel product to be machined. When the value of fn1 represented by equation (1) is not less than 0, the number of drilled holes serving as the "drill life" can be 150 or more in the course of drilling in a structural steel part for machinery a so-called "deep hole" having a (hole depth)/(hole diameter) ratio of not less than 5 by use of a conventional Co-containing high-speed steel drill. Thus, the fn1 value is specified as not less than 0. Employment of an Mn content of 0.15% to 2.00%, an S content in excess of 0.080% and not greater than 0.2%, and an fn1 value of not less than 7.5 provides a very large number of drilled holes; i.e., of not less than 300. The upper limit of the fn1 value is determined from the Hv hardness of steel products of the present invention falling within the range of 160 to 350 and the requirement for fn2, which is a parameter related to machinability and will next be described.

fn2: not less than 3.0

Only when the value of fn2 represented by equation (2) and serving as the "index of chip disposability" is not less than 3.0 and the area percentage of ferrite in microstructure is subjected to appropriate control, which will be described later, chip disposability is improved, thereby facilitating disposal of chips in drilling deep holes (see FIG. 1). Thus, drill life can be stably extended, and the need for posttreatment of chips can be eliminated, thereby enabling automation of work operations. When the fn2 value serving as the "index of chip disposability" is less than 3.0, chip disposability decreases significantly. As a result, as shown in FIG. 1, long chips are produced. Since these long chips must be treated appropriately, automation of work operations becomes difficult to establish. Furthermore, drill life decreases. Accordingly, the fn2 value is specified as not less than 3.0.

The "index of chip disposability" fn2, which is determined by the contents of alloy elements and the area percentage of ferrite, is related to toughness and drill life. Specifically, as hardness increases, chip disposability improves, but toughness and drill life deteriorate. Accordingly, the upper limit of the fn2 value is determined from the Hv hardness of steel products of the present invention falling within the range of 160 to 350 and the requirements for fn1 and ferrite percentage, which are parameters related to machinability. The upper limit of the fn2 value is substantially 8.0.

fn3: not greater than 100

When the S content is 0.005% to 0.080% with other elements being contained in the corresponding content ranges described previously, and the value of fn3 represented by equation (3) is not greater than 100, sufficient toughness can be imparted to high-hardness structural steel parts for machinery; i.e., an absorbed energy at room temperature ($_UE_{RT}$) of not less than 40J can be obtained in an impact test conducted by use of a No. 3 test piece for Charpy impact test specified in JIS Z 2202. Accordingly, for structural steel parts for machinery requiring high toughness, such as wheel hubs, spindles, knuckle arms, and torque arms, preferably, the S content is 0.005% to 0.080%, and the fn3 value is not greater than 100. The lower limit of the fn3 value is determined from the Hv hardness of steel products of the present invention falling within the range of 160 to 350 and the requirements for fn1 and fn2, which are parameters related to machinability.

When structural steel parts for machinery are intended for use in a cold region, in some cases, they may be required to have an absorbed energy at −50° C. ($_UE_{-50}$) of not less than 20J as measured in an impact test conducted by use of a No. 3 test piece for Charpy impact test specified in JIS Z 2202. In this case, the value of fn5 represented by equation (5) below is preferably not greater than 100.

$$fn5=87C+7Si+10Mn+41Cr+15Mo+50V \quad (5)$$

where an element symbol appearing in equation (5) represents the content in mass percent of the corresponding element.

Microstructure of Steel Product

In order to enhance machinability, particularly "chip disposability" in the course of drilling, of steel products for machine structural use having the above-mentioned chemical composition, the area percentage of ferrite in microstructure must be 10% to 80%. Being of a soft phase, ferrite is precedently deformed in the course of drilling to thereby become a starting point of chip breakage, thereby enhancing "chip disposability." However, when the ferrite percentage is less than 10%, this effect is not yielded, resulting in decreased chip disposability. Furthermore, the "index of chip disposability" fn2 indicative of "chip disposability" may assume a value less than 3.0 in some cases. When the ferrite percentage is in excess of 80%, steel products for machine structural use encounter difficulty in assuming a high Hv hardness of not less than 160. Also, a soft microstructure grows excessively, resulting in decreased "chip disposability." Accordingly, the percentage of ferrite in microstructure is specified as 10% to 80%.

As mentioned previously, the area percentage in microstructure is that determined through microscopic observation.

A portion of microstructure other than ferrite includes pearlite, bainite, and martensite. Notably, in order to assume a predetermined microstructure, a steel product is not necessarily subjected to heat treatment after final hot working; i.e., the product may be allowed to cool after final hot working, or may, after hot working, be subjected to heat treatment, such as normalizing, normalizing-tempering, or quenching-tempering. When a microstructure includes transformation structures observed at low temperature, such as bainite and martensite, it is preferable that tempering be performed. From the viewpoint of cost, a non-heat treatment type process, which yields a predetermined microstructure without involvement of heat treatment, is preferred. This "non-heat treatment type process" is advantageous in terms of cost, because of no involvement of heat treatment, and in terms of delivery time, because of the possibility of simplifying a manufacturing process.

Hv Hardness

Structural steel parts for machinery having an Hv hardness of less than 160 may suffer deformation, great wear, or fatigue failure in the course of use, and thus are not useful in spite of excellent machinability thereof. When the Hv hardness is in excess of 350, attainment of desired machinability becomes difficult. Particularly, when the "non-heat treatment type process" is employed, means for enhancing machinability through employment of a ferrite percentage in microstructure of 10% to 80% is hardly effective. Accordingly, the Hv hardness is specified as 160 to 350.

Inclusions

For structural steel parts for machinery requiring high toughness, such as wheel hubs, spindles, knuckle arms, and torque arms, preferably, the S content is 0.005% to 0.080%; the value of fn3 represented by equation (3) is not greater than 100; and the value of fn4 represented by equation (4) in relation to inclusions observed on the L-section of a steel product is not less than 5.0. This is because, in the case of steel products for machine structural use that satisfy the above-mentioned requirements for S content and fn3 value, employment of an fn4 value of not less than 5.0 significantly decreases long-extending MnS inclusions, thereby preventing the structural steel parts formed from the steel products through hot working, such as hot forging, from suffering occurrence of a defect which would result in rejection of the same as defective articles in nondestructive testing, or preventing cracking of the structural steel parts upon subjection to surface hardening serving as a final treatment.

In the case of steel products for machine structural use having an S content of 0.005% to 0.080% among those having the previously specified chemical composition, most inclusions having a maximum diameter in excess of 3 $\mu$m are MnS, and inclusions having a maximum diameter of 0.5 $\mu$m to 3 $\mu$m are sulfides (for example, CrS), carbides, nitrides, and a portion of MnS inclusions.

When the fn4 value is not less than 10, most inclusions assume a maximum diameter of not greater than 3 $\mu$m. Thus, when nondestructive testing employs severe criteria, the fn4 value is preferably not less than 10. The upper limit of the fn4 value is not specified. The greater the fn4 value, the better.

The number of inclusions may be counted through a microscope at such magnification that an inclusion having a maximum diameter of 0.5 $\mu$m can be recognized; for example, at 400 magnifications.

When an fn4 value of not less than 5.0 is to be attained without addition of Cr, for example, (a) the Mn and S contents may be decreased to not greater than 0.5% and not greater than 0.05%, respectively, or (b) Te, Ti, and Nd may be added in the respective appropriate amounts, thereby fining MnS inclusions at the solidification stage of steel and preventing MnS inclusions from extending in subsequent hot working. When inclusions are to be fined and dispersed in the form of CrS through addition of Cr, for example, the Mn content may be not greater than 0.5%, and Cr may be added after deoxidation is performed through addition of Si and Al. Subsequently, Mn may be added.

Preferably, in either of case (a) and case (b) mentioned above, a molten steel is sufficiently stirred in secondary refining, such as vacuum refining or ladle refining, so as to raise coarse MnS inclusions to the surface thereof, and a steel ingot is cooled at a sufficiently high speed in the course of solidification so as to attain a secondary dendrite arm spacing of not greater than 250 $\mu$m. Thus, a steel ingot is manufactured preferably through continuous casting. By following the above procedure, there is obtained a favorable steel ingot featuring little so-called "macrosegregation" and "sulfur segregation."

Conventional free-cutting steels attain improved machinability through control of the form of inclusions and are put into practical use in the form of so-called "oxide-controlled steels." The "oxide-controlled steel" employs the composition of a semi-killed steel as a basic composition while the compositional proportions of oxides, such as $SiO_2$, MnO, $Al_2O_3$, CaO, and $TiO_2$, are controlled appropriately to thereby enhance machinability. By contrast, steel products for machine structural use according to the present invention provide good machinability while having an Hv hardness of 160 to 350, regardless of compositional proportions of inclusions such as oxides, so long as the previously mentioned requirements for chemical composition and microstructure are satisfied.

Satisfying the previously mentioned requirements for inclusions, steel products having an S content of 0.005% and 0.080% and an fn3 value of not greater than 100 can prevent structural steel parts for machinery formed therefrom through, for example, hot forging, from suffering occurrence of a defect which would result in rejection of the same as defective articles in nondestructive testing, or preventing cracking of the structural steel parts upon subjection to surface hardening serving as a final treatment.

Structural steel parts for machinery according to the present invention are manufactured by the steps of roughly forming into a predetermined shape the previously mentioned steel products for machine structural use according to the present invention through hot working, such as hot forging; and machining the thus-formed steel products into a desired shape. This machining step may be followed by heat treatment, such as normalizing, normalizing-tempering, or quenching-tempering. Alternatively, the hot-worked steel products may be subjected to the heat treatment and may then be machined into a desired shape. Notably, a portion of the structural steel parts may be subjected to surface hardening, such as carburizing, nitriding, or induction hardening, or may be subjected to plastic working, such as shot peening.

EXAMPLES

The present invention will next be described by way of example, which should not be construed as limiting the invention.

Example 1

Steels having chemical compositions shown in Tables 1 to 4 were smelted by use of a 150 kg vacuum smelter or a 70-ton converter. Steels A4 and B8 were smelted in the 70-ton converter, followed by continuous casting. Other steels were all smelted in the 150 kg vacuum smelter. Tables 1 to 4 also =show the value of fn1 represented by equation (1). The O (oxygen) content of steel B11 was 0.0187% greater than a preferable level of 0.015%. All other steels exhibited an oxygen content not greater than 0.015%.

Steels Al to B20 and D1 to D4 in Tables 1 to 4 contain component elements such that their amounts fall within the corresponding ranges specified in the present invention, and satisfy the requirement for the fn1 value specified in the present invention.

In steels C1 to C13 in Tables 3 and 4, the content of a certain component element contained therein falls outside the corresponding range specified in the present invention. Particularly, steel C8 also fails to satisfy the requirement for the fn1 value specified in the present invention.

TABLE 1

| | Chemical composition (mass %) Balance: Fe and impurities | | | | | | | | | | |
|---|---|---|---|---|---|---|---|---|---|---|---|
| Steel | C | Si | Mn | S | Cr | P | V | N | Al | Others | fn1 |
| A1 | 0.09 | 0.97 | 1.87 | 0.149 | — | 0.017 | 0.30 | 0.0040 | 0.010 | — | 16.2 |
| A2 | 0.33 | 0.88 | 1.22 | 0.117 | — | 0.033 | — | 0.0068 | — | — | 12.5 |
| A3 | 0.49 | 1.16 | 0.23 | 0.096 | — | 0.010 | 0.11 | 0.0050 | 0.016 | — | 9.9 |
| A4 | 0.42 | 0.99 | 0.34 | 0.106 | — | 0.029 | — | 0.0021 | 0.023 | — | 13.0 |
| A5 | 0.26 | 1.03 | 0.89 | 0.083 | — | 0.007 | 0.33 | 0.0030 | 0.025 | — | 8.8 |
| A6 | 0.36 | 1.15 | 1.25 | 0.100 | — | 0.013 | — | 0.0081 | 0.006 | Ca: 0.005, Te: 0.03 | 10.2 |
| A7 | 0.39 | 1.03 | 0.52 | 0.119 | — | 0.023 | — | 0.0070 | 0.010 | Pb: 0.11, Se: 0.10 | 14.4 |
| A8 | 0.40 | 0.69 | 0.82 | 0.097 | — | 0.028 | 0.12 | 0.0059 | 0.024 | Nb: 0.04 | 9.0 |
| A9 | 0.41 | 0.69 | 0.77 | 0.114 | — | 0.025 | 0.09 | 0.0065 | 0.003 | B: 0.0023, Bi: 0.09 | 11.0 |
| A10 | 0.24 | 1.24 | 1.49 | 0.086 | — | 0.009 | 0.20 | 0.0070 | 0.012 | Mo: 0.21 | 8.8 |
| B1 | 0.08 | 1.06 | 0.82 | 0.129 | 1.56 | 0.016 | 0.24 | 0.0035 | 0.009 | — | 14.5 |
| B2 | 0.52 | 1.26 | 0.17 | 0.127 | 0.16 | 0.025 | 0.08 | 0.0090 | 0.013 | — | 12.5 |
| B3 | 0.26 | 0.51 | 0.38 | 0.096 | 1.51 | 0.027 | — | 0.0035 | 0.027 | — | 10.0 |

$fnl = -23C + Si(5 - 2Si) - 4Mn + 104S - 3Cr - 9V + 10$ (Each element symbol appearing in the above equation represents the content of the corresponding element.)

TABLE 2

| | Chemical composition (mass %) Balance: Fe and impurities | | | | | | | | | | |
|---|---|---|---|---|---|---|---|---|---|---|---|
| Steel | C | Si | Mn | S | Cr | P | V | N | Al | Others | fn1 |
| B4 | 0.28 | 1.00 | 0.79 | 0.123 | 0.79 | 0.004 | — | 0.0025 | 0.030 | — | 13.8 |
| B5 | 0.30 | 0.79 | 1.03 | 0.103 | 0.90 | 0.003 | 0.13 | 0.0080 | 0.012 | — | 8.5 |
| B6 | 0.37 | 2.03 | 0.37 | 0.139 | 1.09 | 0.010 | — | 0.0052 | 0.036 | Te: 0.03 | 13.1 |
| B7 | 0.09 | 1.13 | 0.51 | 0.099 | 1.68 | 0.016 | 0.22 | 0.0021 | 0.023 | — | 12.3 |
| B8 | 0.34 | 1.09 | 0.35 | 0.088 | 0.57 | 0.014 | — | 0.0043 | 0.007 | Pb: 0.08, Nb: 0.03 | 10.4 |
| B9 | 0.23 | 1.02 | 0.18 | 0.083 | 1.57 | 0.009 | — | 0.0037 | 0.013 | Ni: 0.85, Ti: 0.02 | 10.9 |
| B10 | 0.49 | 1.26 | 0.22 | 0.100 | 0.88 | 0.020 | — | 0.0055 | 0.009 | Cu: 0.55, Se: 0.11 | 8.7 |
| B11 | 0.46 | 1.10 | 0.38 | 0.120 | 0.23 | 0.021 | 0.40 | 0.0047 | 0.002 | — | 9.2 |
| B12 | 0.25 | 1.06 | 0.67 | 0.092 | 1.42 | 0.022 | 0.10 | 0.0044 | 0.007 | — | 9.0 |
| B13 | 0.33 | 1.00 | 0.51 | 0.093 | 0.99 | 0.014 | 0.11 | 0.0056 | 0.020 | Ti: 0.034, Nd: 0.03 | 9.1 |
| B14 | 0.27 | 1.15 | 0.87 | 0.144 | 1.09 | 0.017 | 0.36 | 0.0026 | 0.008 | Mo: 0.14, Ca: 0.002 | 11.9 |
| B15 | 0.25 | 0.98 | 0.78 | 0.100 | 1.42 | 0.006 | 0.10 | 0.0075 | 0.002 | Bi: 0.03 | 9.3 |
| B16 | 0.20 | 1.16 | 0.80 | 0.103 | 1.53 | 0.013 | 0.10 | 0.0090 | 0.033 | — | 10.5 |

$fnl = -23C + Si(5 - 2Si) - 4Mn + 104S - 3Cr - 9V + 10$ (Each element symbol appearing in the above equation represents the content of the corresponding element.)

TABLE 3

| | Chemical composition (mass %) Balance: Fe and impurities | | | | | | | | | | |
|---|---|---|---|---|---|---|---|---|---|---|---|
| Steel | C | Si | Mn | S | Cr | P | V | N | Al | Others | fn1 |
| B17 | 0.35 | 1.16 | 0.80 | 0.143 | 0.83 | 0.013 | 0.10 | 0.0146 | 0.033 | — | 13.3 |
| B18 | 0.31 | 0.69 | 1.30 | 0.119 | 1.57 | 0.027 | — | 0.0066 | 0.029 | — | 7.8 |
| B19 | 0.52 | 0.56 | 1.30 | 0.144 | 0.33 | 0.011 | — | 0.0103 | 0.026 | — | 9.0 |
| B20 | 0.26 | 0.59 | 1.06 | 0.092 | 1.34 | 0.029 | — | 0.0146 | 0.017 | — | 7.6 |
| C1 | *0.04 | 1.79 | 0.89 | 0.086 | — | 0.007 | — | 0.0123 | 0.023 | — | 17.0 |
| C2 | *0.59 | 0.68 | 0.55 | 0.075 | 0.25 | 0.022 | 0.08 | 0.0026 | 0.010 | — | 3.0 |
| C3 | 0.40 | *0.27 | 1.37 | 0.103 | — | 0.017 | 0.06 | 0.0065 | *0.047 | — | 6.7 |
| C4 | 0.39 | *2.66 | 1.28 | 0.081 | — | 0.013 | — | 0.0125 | 0.010 | — | 3.3 |
| C5 | 0.33 | 0.95 | *2.47 | 0.091 | 1.11 | 0.030 | — | 0.0073 | 0.026 | — | 1.6 |
| C6 | 0.37 | 0.87 | 1.13 | 0.096 | *2.29 | *0.053 | — | 0.0062 | 0.021 | — | 2.9 |
| C7 | 0.25 | 1.16 | 0.77 | 0.075 | 1.52 | 0.017 | *0.57 | 0.0056 | 0.010 | — | 2.4 |

TABLE 3-continued

| | Chemical composition (mass %) Balance: Fe and impurities | | | | | | | | | | |
|---|---|---|---|---|---|---|---|---|---|---|---|
| Steel | C | Si | Mn | S | Cr | P | V | N | Al | Others | fn1 |

fnl = − 23C + Si(5 − 2Si) − 4Mn + 104S − 3Cr − 9V + 10
(Each element symbol appearing in the above equation represents the content of the corresponding element.)
A value marked with * falls outside the corresponding range specified in the present invention.

TABLE 4

| | Chemical composition (mass %) Balance: Fe and impurities | | | | | | | | | | |
|---|---|---|---|---|---|---|---|---|---|---|---|
| Steel | C | Si | Mn | S | Cr | P | V | N | Al | Others | fn1 |
| C8 | 0.40 | 0.57 | *2.43 | 0.091 | 1.03 | 0.027 | — | *0.0251 | 0.009 | *Ni: 2.24 | *−0.3 |
| C9 | 0.36 | 0.77 | 1.13 | 0.095 | 1.26 | 0.017 | 0.18 | 0.0075 | 0.017 | *Mo: 1.84 | 4.3 |
| C10 | 0.46 | 1.15 | 0.90 | 0.087 | 1.57 | 0.008 | — | 0.0047 | 0.030 | *B: 0.010, *Bi: 0.17 | 3.3 |
| C11 | 0.30 | 1.00 | 1.21 | 0.090 | 0.90 | 0.030 | — | 0.0043 | 0.032 | *Pb: 0.26, *Te: 0.07 | 7.9 |
| C12 | 0.39 | 0.58 | 1.26 | 0.110 | — | 0.023 | — | 0.0103 | 0.030 | *CU: 1.89 | 9.7 |
| C13 | 0.51 | 0.93 | 1.22 | 0.126 | 0.60 | 0.015 | 0.15 | *0.0171 | 0.023 | *Nb: 0.13 | 6.3 |
| D1 | 0.37 | 0.90 | 1.07 | 0.081 | 1.00 | 0.021 | 0.09 | 0.0120 | 0.020 | — | 4.6 |
| D2 | 0.49 | 0.72 | 1.09 | 0.090 | 1.06 | 0.036 | 0.14 | 0.0068 | 0.032 | — | 1.9 |
| D3 | 0.16 | 2.26 | 1.30 | 0.088 | 1.56 | 0.024 | 0.30 | 0.0060 | 0.017 | — | 3.1 |
| D4 | 0.41 | 0.59 | 1.46 | 0.092 | 0.22 | 0.029 | — | 0.0088 | 0.017 | — | 5.9 |

fnl = − 23C + Si(5 − 2Si) − 4Mn + 104S − 3Cr − 9V + 10
(Each element symbol appearing in the above equation represents the content of the corresponding element.)
A value marked with * falls outside the corresponding range specified in the present invention.

Next, these steel ingots were hot-forged in such a manner as to be heated to a temperature of 1250° C. and then be finished at a temperature of 1000° C. or higher, thereby obtaining round bars, each having a diameter of 60 mm. The hot-forged round bars were air-cooled so as to simulate a process for manufacturing non-heat treatment type steels. After being air-cooled, steels A3, A4, A8, B4, B5, B129, C5, C6, C12, D2, and D3 were heated to a temperature of 850° C. to 1000° C. according to the chemical compositions of the steels and then normalized or quenched, followed by tempering except for steel D2.

No. 14A test pieces for the tensile test (diameter of a parallel portion: 8 mm) specified in JIS Z 2201 were taken from the thus-obtained round bars such that each of the tensile test pieces extends in parallel with a hot-forging direction from a position corresponding to ½ the radius of each of the round bars; i.e., from a position located 15 mm below the surface of each of the round bars. The steels were tested for tensile characteristics at room temperature by use of the tensile test pieces. In the description below, the position corresponding to ½ the radius of the round bars is called the R/2 position.

Hardness test pieces, each having a length of 20 mm, were cut out from the round bars of a 60 mm diameter. Hv hardness was measured at the R/2 position on the thus-obtained section. Hv hardness was measured at 6 positions of each of the test pieces. The average of the measured values was taken as the Hv hardness of the test piece.

Furthermore, test pieces were taken from the round bars such that each of the test pieces extends in parallel with the hot-forging direction while the R/2 position was located at the center of the test piece. The thus-obtained L-section on each of the test pieces was mirror-like polished and then etched by nital. The thus-prepared surface was observed for microstructure at the R/2 position though an optical microscope at 400 magnifications, thereby measuring the percentage (area percentage) of ferrite and judging the microstructure.

A drilling test and a turning test were also conducted in order to examine machinability.

In the drilling test, a hole of a 50 mm depth was drilled diametrally in each of the round bars of a 60 mm diameter. The number of holes which had been drilled until drilling became disabled due to wear of the drill was defined as drill life. Drilling was performed by use of high-speed steel drills, each having a diameter of 6.0 mm, an overall length of 225 mm, and a point angle of 118 degrees and containing Co in an amount of 6%, and under the following conditions: lubricant: emulsion type water-soluble cutting fluid; revolutions per minute: 980; and feed per revolution: 0.15 mm/rev.

The turning test used carbide tips, each having a chip breaker formed therein and being coated with Ti (C, N)-alumina-TiN, and was conducted under the following conditions: lubrication: not performed; cutting speed: 160 m/min; feed per revolution: 0.25 mm/rev.; and depth of cut: 3 mm. Machinability was evaluated in terms of wear of the flank of each of the tips as measured after machining was performed for 30 minutes.

Steels C10 and C11 suffered cracking in the course of hot forging. Thus, steels C10 and C11 were subjected only to the above-mentioned observation of microstructure at the R/2 position for measurement of the percentage (area percentage) of ferrite and judgement on microstructure.

Tables 5 to 8 show the results of the above-mentioned tests. Symbols appearing in the "heat treatment" column of Tables 5 to 8 have the following meaning: N: normalizing; T: tempering; Q: quenching; and -: non-heat-treated. Symbols appearing in the "microstructure" column have the following meaning: F: ferrite; P: pearlite; B: bainite; and M: martensite. As mentioned previously, the symbol "α" denotes the area percentage of ferrite in microstructure. In these Tables, tempering temperature (° C.) is parenthesized.

The microstructures of steels C10 and C11 assumed the phases "B+M" and "F+M" and ferrite percentages (α) of 0% and 21%, respectively. Accordingly, when the respective round bars of a 60 mm diameter were manufactured under the previously mentioned conditions, the fn2 value was 3.6 for steel C10 and 5.4 for steel C11.

TABLE 5

| Test number | Steel | Heat Treatment | Micro-structure Phase | α (%) | fn2 | Tensile characteristics TS (MPa) | YS (MPa) | YS/TS | reduction of area (%) | Hv hardness | Drill life (number of drilled holes) | Amount of tool wear on turning (μm) |
|---|---|---|---|---|---|---|---|---|---|---|---|---|
| 1 | A1 | — | F + P | 73 | 6.2 | 590 | 453 | 0.77 | 69.4 | 184 | 1059 | 20 |
| 2 | A2 | — | F + P | 61 | 6.0 | 718 | 435 | 0.60 | 24.5 | 225 | 681 | 74 |
| 3 | A3 | NT(600) | F + P + B | 29 | 4.6 | 890 | 505 | 0.57 | 26.5 | 281 | 408 | 126 |
| 4 | A4 | NT(600) | F + P + B | 25 | 4.5 | 775 | 423 | 0.55 | 26.5 | 244 | 565 | 112 |
| 5 | A5 | — | F + P | 79 | 5.7 | 736 | 538 | 0.73 | 41.8 | 231 | 351 | 16 |
| 6 | A6 | — | F + P | 56 | 5.8 | 771 | 483 | 0.63 | 20.4 | 243 | 514 | 82 |
| 7 | A7 | — | F + P | 73 | 5.9 | 755 | 412 | 0.55 | 28.6 | 238 | 908 | 91 |
| 8 | A8 | QT(650) | F + M + B | 23 | 4.2 | 796 | 489 | 0.61 | 23.5 | 251 | 311 | 106 |
| 9 | A9 | — | F + P | 64 | 6.3 | 794 | 462 | 0.58 | 28.6 | 251 | 513 | 107 |
| 10 | A10 | — | F + P | 65 | 5.8 | 749 | 544 | 0.73 | 58.1 | 236 | 401 | 12 |
| 11 | B1 | — | F + P | 29 | 4.9 | 639 | 444 | 0.70 | 69.4 | 200 | 899 | 34 |
| 12 | B2 | — | F + P | 62 | 5.7 | 925 | 480 | 0.52 | 28.6 | 293 | 833 | 126 |

In the "heat treatment" column, the symbol "—" denotes non-heat-treated; "N" normalizing; "T" tempering; and "Q" quenching. A parenthesized value denotes temperature (° C.).
In the "microstructure" column, the symbol "F" denotes ferrite; "P" pearlite; "B" bainite; "M" martensite; and "α" area percentage of ferrite.
In the "tensile characteristics" column, the symbol "TS" denotes tensile strength, and "YS" denotes yield strength.

TABLE 6

| Test number | Steel | Heat Treatment | Micro-structure Phase | α (%) | fn2 | Tensile characteristics TS (MPa) | YS (MPa) | YS/TS | reduction of area (%) | Hv hardness | Drill life (number of drilled holes) | Amount of tool wear on turning (μm) |
|---|---|---|---|---|---|---|---|---|---|---|---|---|
| 13 | B3 | — | F + P | 21 | 4.3 | 697 | 411 | 0.59 | 35.7 | 228 | 366 | 103 |
| 14 | B4 | NT(600) | F + B + M | 16 | 4.1 | 811 | 513 | 0.63 | 27.5 | 228 | 628 | 62 |
| 15 | B5 | QT(650) | F + M | 26 | 4.5 | 860 | 623 | 0.72 | 46.9 | 228 | 428 | 77 |
| 16 | B6 | — | F + P | 28 | 5.0 | 883 | 479 | 0.54 | 30.6 | 279 | 1215 | 54 |
| 17 | B7 | — | F + P | 31 | 4.9 | 641 | 455 | 0.71 | 59.2 | 201 | 698 | 21 |
| 18 | B8 | — | F + P | 57 | 5.9 | 742 | 444 | 0.60 | 26.5 | 233 | 519 | 98 |
| 19 | B9 | — | F + P | 30 | 4.7 | 687 | 414 | 0.60 | 37.7 | 216 | 577 | 76 |
| 20 | B10 | — | F + P | 27 | 4.8 | 938 | 514 | 0.55 | 27.5 | 297 | 399 | 150 |
| 21 | B11 | — | F + P | 19 | 4.1 | 984 | 609 | 0.62 | 17.3 | 319 | 305 | 90 |
| 22 | B12 | — | F + P | 20 | 4.2 | 760 | 493 | 0.65 | 43.9 | 240 | 358 | 64 |
| 23 | B13 | — | F + P | 34 | 5.0 | 852 | 544 | 0.64 | 24.5 | 270 | 359 | 89 |
| 24 | B14 | — | F + P | 13 | 4.1 | 898 | 580 | 0.65 | 30.6 | 300 | 662 | 6 |

In the "heat treatment" column, the symbol "—" denotes non-heat-treated; "N" normalizing; "T" tempering; and "Q" quenching. A parenthesized value denotes temperature (° C).
In the "microstructure" column, the symbol "F" denotes ferrite; "P" pearlite; "B" bainite; "M" martensite; and "α" area percentage of ferrite.
In the "tensile characteristics" column, the symbol "TS" denotes tensile strength, and "YS" denotes yield strength.

TABLE 7

| Test number | Steel | Heat Treatment | Micro-structure Phase | α (%) | fn2 | Tensile characteristics TS (MPa) | YS (MPa) | YS/TS | reduction of area (%) | Hv hardness | Drill life (number of drilled holes) | Amount of tool wear on turning (μm) |
|---|---|---|---|---|---|---|---|---|---|---|---|---|
| 25 | B15 | — | F + P | 21 | 4.2 | 761 | 490 | 0.64 | 43.9 | 240 | 368 | 64 |
| 26 | B16 | — | F + P | 15 | 3.3 | 729 | 478 | 0.66 | 63.2 | 229 | 325 | 37 |
| 27 | B17 | — | F + P | 13 | 2.7 | 989 | 548 | 0.55 | 12.2 | 314 | 289 | 123 |
| 28 | B18 | — | B + M | 0 | 2.6 | 821 | 504 | 0.61 | 41.8 | 260 | 231 | 107 |
| 29 | B19 | NT(600) | B + M | 0 | 2.4 | 939 | 512 | 0.55 | 27.5 | 298 | 272 | 162 |
| 30 | B20 | — | F + P | 8 | 2.1 | 726 | 468 | 0.64 | 41.8 | 228 | 179 | 98 |
| 31 | C1 | — | F + P | 96 | 3.1 | 440 | 338 | 0.77 | 52.0 | 135 | 368 | 92 |
| 32 | C2 | — | F + P | 6 | 3.3 | 997 | 580 | 0.58 | 17.3 | 317 | 165 | 206 |
| 33 | C3 | — | F + P | 41 | 5.8 | 779 | 485 | 0.62 | 24.5 | 246 | 205 | 223 |
| 34 | C4 | — | F + P | 51 | 5.2 | 907 | 598 | 0.66 | 20.4 | 287 | 168 | 213 |
| 35 | C5 | NT(550) | M + B | 0 | 3.2 | 888 | 629 | 0.71 | 26.5 | 281 | 87 | 107 |

TABLE 7-continued

| Test number | Steel | Heat Treatment | Micro-structure Phase | α (%) | fn2 | Tensile characteristics TS (MPa) | YS (MPa) | YS/TS | reduction of area (%) | Hv hardness | Drill life (number of drilled holes) | Amount of tool wear on turning (μm) |
|---|---|---|---|---|---|---|---|---|---|---|---|---|

In the "heat treatment" column, the symbol "—" denotes non-heat-treated; "N" normalizing; "T" tempering; and "Q" guenching. A parenthesized value denotes temperature (° C).
In the "microstructure" column, the symbol "F" denotes ferrite; "P" pearlite; "B" bainite; "M" martensite; and "α" area percentage of ferrite.
In the "tensile characteristics" column, the symbol "TS" denotes tensile strength, and "YS" denotes yield strength.

TABLE 8

| Test number | Steel | Heat Treatment | Micro-structure Phase | α (%) | fn2 | Tensile characteristics TS (MPa) | YS (MPa) | YS/TS | reduction of area (%) | Hv hardness | Drill life (number of drilled holes) | Amount of tool wear on turning (μm) |
|---|---|---|---|---|---|---|---|---|---|---|---|---|
| 36 | C6 | QT(600) | M | 0 | 3.0 | 952 | 591 | 0.62 | 31.6 | 302 | 152 | 226 |
| 37 | C7 | — | F + P | 11 | 3.2 | 934 | 605 | 0.65 | 27.5 | 296 | 168 | 37 |
| 38 | C8 | — | B + M | 0 | 1.2 | 931 | 636 | 0.68 | 24.5 | 295 | 45 | 234 |
| 39 | C9 | — | B + M | 0 | 2.3 | 1086 | 765 | 0.70 | 12.2 | 348 | 111 | 276 |
| 40 | C12 | QT(600) | F + B + M | 6 | 2.3 | 766 | 460 | 0.60 | 16.3 | 242 | 284 | 195 |
| 41 | C13 | — | F + P | 9 | 2.6 | 1016 | 605 | 0.60 | 18.4 | 322 | 150 | 218 |
| 42 | D1 | — | F + P | 11 | 2.9 | 865 | 564 | 0.65 | 33.7 | 273 | 150 | 118 |
| 43 | D2 | N | B + M | 0 | 2.6 | 1008 | 630 | 0.62 | 24.5 | 320 | 150 | 239 |
| 44 | D3 | QT(550) | F + B | 5 | 2.6 | 853 | 658 | 0.77 | 38.8 | 270 | 223 | 47 |
| 45 | D4 | — | F + P | 33 | 5.2 | 941 | 591 | 0.63 | 28.6 | 259 | 173 | 199 |

In the "heat treatment" column, the symbol "—" denotes non-heat-treated; "N" normalizing; "T" tempering; and "Q" quenching. A parenthesized value denotes temperature (° C).
In the "microstructure" column, the symbol "F" denotes ferrite; "P" pearlite; "B" bainite; "M" martensite; and "α" area percentage of ferrite.
In the "tensile characteristics" column, the symbol "TS" denotes tensile strength, and "YS" denotes yield strength.

As shown in Tables 5 to 8, in the case of the steels of test Nos. 1 to 26 and 45, which contain component elements such that their amounts fall within the corresponding ranges specified in the present invention and which satisfy the requirements specified in the present invention for the fn1 value, the fn2 value, and the percentage of ferrite in microstructure, in spite of a high Hv hardness of 184 to 319, the steels bring about excellent drill life and exhibits good "chip disposability." Also, the steels exhibit excellent machinability on turning; specifically, a tool wear on turning of less than 200 μm. Particularly, the steels of test Nos. 1 to 26 contain Mn in an amount of 0.17% to 1.87% and S in an amount of 0.083t to 0.149%, thus satisfying the requirement for the Mn content, 0.15% to 2.00%, and the requirement for S content, in excess of 0.080% and not greater than 0.2%. Furthermore, the fn1 value is 8.5 to 16.2, which is greater than a required fn1 value of not less than 7.5. As a result, the number of drilled holes is not less than 300, indicating that the steels bring about excellent drill life.

Steels B17 and D1 of test Nos. 27 and 42 contain component elements such that their amounts fall within the corresponding ranges specified in the present invention, and satisfy the requirement for the fn1 value specified in the present invention (see Tables 3 and 4); however, the fn2 value falls outside the corresponding range specified in the present invention, indicating that "chip disposability" thereof is relatively low.

Steels B18 to B20, D2, and D3 of test Nos. 28 to 30, 43, and 44 contain component elements such that their amounts fall within the corresponding ranges specified in the present invention, and satisfy the requirement for the fn1 value specified in the present invention (see Tables 3 and 4); however, the fn2 value and the ferrite percentage fall outside the respective ranges specified in the present invention. As a result, "chip disposability" is relatively low.

In the case of the steels of test Nos. 31 to 41, at least any one of the content of a certain component element, the fn1value, the fn2 value, and the percentage of ferrite in microstructure falls outside the corresponding range specified in the present invention. As a result, the steels exhibit a relatively low Hv hardness of 135, the number of drilled holes less than 150 indicating decreased drill life, or low "chip disposability" or tool wear on turning.

As mentioned previously, steels C10 and C11 suffered cracking in the course of hot forging. Thus, steels C10 and C11 were subjected only to the microstructure observation for measurement of the percentage of ferrite and judgement on microstructure. Other tests were not conducted on the steels.

Example 2

Various steels having a variable Si content and a basic chemical composition of 0.43%C–0.6%Mn–0.10%S–0.5%Cr–0.01% Al–0.005%N–0.02%P were smelted by use of the 150 kg vacuum smelter.

Next, these steel ingots were hot-forged in such a manner as to be heated to a temperature of 1250° C. and then be finished at a temperature of 1000° C. or higher, thereby obtaining round bars, each having a diameter of 60 mm. The hot-forged round bars were air-cooled so as to simulate a process for manufacturing non-heat treatment type steels.

The thus-obtained round bars of a 60 mm diameter were subjected to a turning test conducted under the same conditions as those of Example 1.

Figure 2:
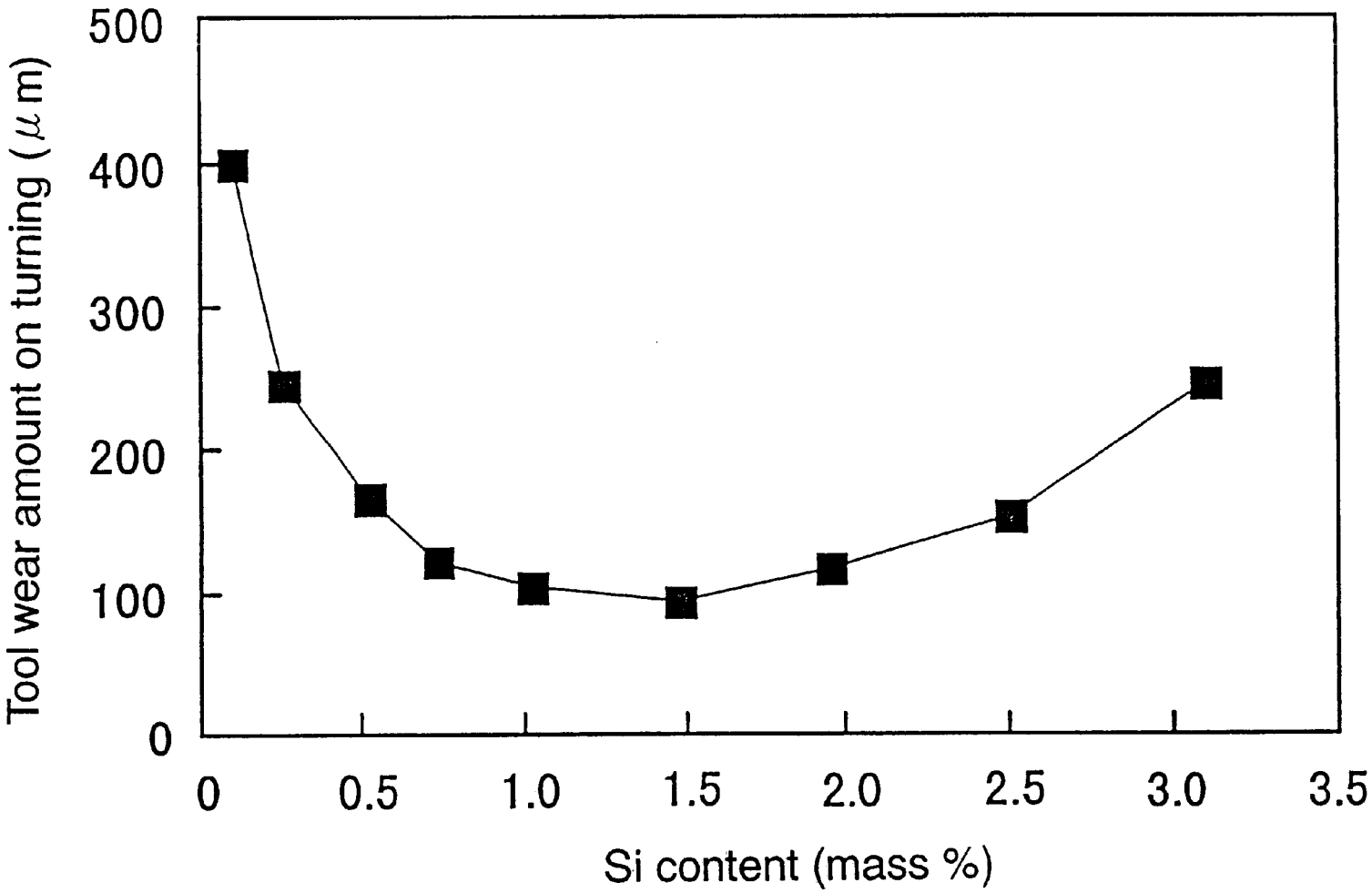
FIG. 2 is a graph showing the relationship between the Si content and the amount of tool wear on turning in steels having a basic chemical composition of 0.43%C–0.6%Mn–0.02% P–0.10%S–0.5%Cr–0.01%Al–0.005%N, where "%" denotes "mass percent"

FIG. 2 shows the effect of the Si content on the amount of tool wear on turning.

As shown in FIG. 2, when the Si content becomes 0.50% or higher, the amount of tool wear on turning decreases to 200 μm or less. However, when the Si content exceeds 2.5%, the amount of tool wear on turning increases sharply.

Example 3

Steels having chemical compositions shown in Tables 9 to 12 were smelted by use of the 150 kg vacuum smelter or the 70-ton converter. Steels E4 and F8 were smelted in the 70-ton converter, followed by continuous casting. Other steels were all smelted in the 150 kg vacuum smelter. Tables 9 to 12 also show the value of fn1 represented by equation (1), the value of fn3 represented by equation (3), and the value of fn5 represented by equation (5). The O (oxygen) content of steel F11 was 0.0195% greater than a preferable level of 0.015%. All other steels exhibited an oxygen content not greater than 0.015%.

Steels E1 to E16 and H1 in Tables 9, 10, and 12 contain component elements such that their amounts fall within the corresponding ranges specified in the present invention, and satisfy the requirement for the fn1 value specified in the present invention.

Steels G1 and G7 in Table 11 satisfy the requirement for the fn1 value specified in the present invention; however, the content of a certain component element contained therein falls outside the corresponding range specified in the present invention. Steels H2 to H8 in Table 12 contain component elements such that their amounts fall within the corresponding ranges specified- in the present invention; however, the fn1value falls outside the corresponding range specified in the present invention. Steels G2 to G6, G8 to G14, and J1 in Tables 11 and 12 are such that the content of a certain component element contained therein falls outside the corresponding range specified in the present invention and such that the fn1 value falls outside the corresponding range specified in the present invention. Steel J1 mentioned above corresponds to the conventional resulfurized free-cutting steel.

Steels E3 and E4 are such that the Mn and S contents are decreased so as to fine MnS inclusions and such that the value of fn4 represented by equation (4) is not less than 5.0.

In manufacture of steels F1 to F3, F6 to F16, G2, G6, G7, H1 and H2, and H5, in order to preferentially generate Cr sulfides, deoxidation was first performed through addition of Si; then, Cr was added; next, Al was added; finally, Mn was added, thereby controlling the value of fn4 represented by equation (4) to not less than 5.0.

TABLE 9

| | Chemical composition (mass %) Balance: Fe and impurities | | | | | | | | | | | | |
|---|---|---|---|---|---|---|---|---|---|---|---|---|---|
| Steel | C | Si | Mn | S | Cr | P | V | N | Al | Others | fn1 | fn3 | fn5 |
| E1 | 0.08 | 0.96 | 1.86 | 0.078 | — | 0.016 | 0.29 | 0.0039 | 0.009 | — | 9.2 | 54 | 47 |
| E2 | 0.32 | 0.87 | 1.21 | 0.046 | — | 0.032 | — | 0.0067 | — | — | 5.4 | 63 | 46 |
| E3 | 0.48 | 1.15 | 0.22 | 0.025 | — | 0.009 | 0.10 | 0.0049 | 0.015 | — | 2.9 | 65 | 57 |
| E4 | 0.41 | 0.98 | 0.33 | 0.035 | — | 0.028 | — | 0.0020 | 0.022 | — | 5.9 | 58 | 46 |
| E5 | 0.25 | 1.02 | 0.88 | 0.009 | — | 0.006 | 0.32 | 0.0029 | 0.024 | — | 1.8 | 54 | 54 |
| E6 | 0.35 | 1.14 | 1.24 | 0.029 | — | 0.012 | — | 0.0080 | 0.005 | Ca: 0.005, Te: 0.02 | 3.1 | 70 | 51 |
| E7 | 0.38 | 1.02 | 0.51 | 0.048 | — | 0.022 | — | 0.0069 | 0.009 | Pb: 0.11, Se: 0.11 | 7.2 | 58 | 45 |
| E8 | 0.39 | 0.68 | 0.81 | 0.026 | — | 0.027 | 0.11 | 0.0058 | 0.023 | Nb: 0.05 | 2.0 | 62 | 52 |
| E9 | 0.40 | 0.68 | 0.76 | 0.043 | — | 0.024 | 0.08 | 0.0064 | 0.002 | B: 0.0026, Bi: 0.09 | 4.0 | 62 | 51 |
| E10 | 0.23 | 1.23 | 1.48 | 0.015 | — | 0.008 | 0.19 | 0.0069 | 0.011 | Mo: 0.21 | 1.8 | 74 | 56 |
| F1 | 0.07 | 1.05 | 0.81 | 0.058 | 1.55 | 0.015 | 0.23 | 0.0034 | 0.008 | — | 7.5 | 84 | 97 |
| F2 | 0.51 | 1.25 | 0.08 | 0.056 | 0.15 | 0.024 | 0.07 | 0.0089 | 0.012 | — | 5.8 | 71 | 64 |
| F3 | 0.25 | 0.50 | 0.37 | 0.025 | 1.50 | 0.026 | — | 0.0034 | 0.026 | — | 2.9 | 85 | 90 |

fnl = − 23C + Si(5 − 2Si) − 4Mn + 104S − 3Cr − 9V + 10 fn3 = 100C + 11Si + 18Mn + 32Cr + 45Mo + 6V fns = 87C + 7Si + 10Mn + 41Cr + 15Mo + 50V (Each element symbol appearing in the above equations represents the content of the corresponding element.)

TABLE 10

| | Chemical composition (mass %) Balance: Fe and impurities | | | | | | | | | | | | |
|---|---|---|---|---|---|---|---|---|---|---|---|---|---|
| Steel | C | Si | Mn | S | Cr | P | V | N | Al | Others | fn1 | fn3 | fn5 |
| F4 | 0.27 | 0.99 | 0.78 | 0.052 | 0.78 | 0.003 | — | 0.0024 | 0.029 | — | 6.7 | 77 | 70 |
| F5 | 0.29 | 0.78 | 1.02 | 0.032 | 0.89 | 0.002 | 0.12 | 0.0079 | 0.011 | — | 1.5 | 85 | 83 |
| F6 | 0.36 | 2.02 | 0.36 | 0.068 | 1.08 | 0.009 | — | 0.0051 | 0.035 | Te: 0.02 | 6.1 | 99 | 93 |
| F7 | 0.08 | 1.12 | 0.50 | 0.028 | 1.67 | 0.015 | 0.21 | 0.0020 | 0.022 | — | 5.3 | 84 | 99 |
| F8 | 0.33 | 1.08 | 0.34 | 0.008 | 0.56 | 0.013 | — | 0.0042 | 0.006 | Pb: 0.08. Nb: 0.02 | 3.3 | 69 | 63 |
| F9 | 0.22 | 1.01 | 0.08 | 0.012 | 1.56 | 0.008 | — | 0.0036 | 0.012 | Ni: 0.87, Ti: 0.03 | 4.2 | 84 | 91 |
| F10 | 0.48 | 0.25 | 0.21 | 0.029 | 0.87 | 0.019 | — | 0.0054 | 0.008 | Cu: 0.59, Se: 0.12 | 1.7 | 93 | 88 |
| F11 | 0.45 | 1.09 | 0.37 | 0.049 | 0.22 | 0.020 | 0.39 | 0.0046 | 0.001 | — | 2.2 | 73 | 79 |
| F12 | 0.24 | 1.05 | 0.66 | 0.021 | 1.41 | 0.021 | 0.09 | 0.0043 | 0.006 | — | 2.0 | 93 | 97 |
| F13 | 0.32 | 0.99 | 0.50 | 0.022 | 0.98 | 0.013 | 0.10 | 0.0055 | 0.019 | Ti: 0.038, Nd: 0.03 | 2.1 | 84 | 85 |
| F14 | 0.26 | 1.14 | 0.86 | 0.073 | 1.08 | 0.016 | 0.35 | 0.0025 | 0.007 | Mo: 0.15, Ca: 0.001 | 4.9 | 97 | 103 |
| F15 | 0.24 | 0.97 | 0.77 | 0.029 | 1.41 | 0.005 | 0.09 | 0.0074 | 0.001 | Bi: 0.03 | 2.3 | 94 | 98 |
| F16 | 0.19 | 1.15 | 0.79 | 0.032 | 1.52 | 0.012 | 0.09 | 0.0089 | 0.032 | — | 3.5 | 95 | 99 |

fn1 = − 23C + Si(5 − 2Si) − 4Mn + 104S − 3Cr − 9V + 10 fn3 = 100C + 11Si + 18Mn + 32Cr + 45Mo + 6V

TABLE 10-continued

| | Chemical composition (mass %) Balance: Fe and impurities | | | | | | | | | | | | |
|---|---|---|---|---|---|---|---|---|---|---|---|---|---|
| Steel | C | Si | Mn | S | Cr | P | V | N | Al | Others | fn1 | fn3 | fn5 |

fn5 = 87C + 7Si + 10Mn + 41Cr + 15Mo + 50V
(Each element symbol appearing in the above equations represents the content of the corresponding element.)

TABLE 11

| | Chemical composition (mass %) Balance: Fe and impurities | | | | | | | | | | | | |
|---|---|---|---|---|---|---|---|---|---|---|---|---|---|
| Steel | C | Si | Mn | S | Cr | P | V | N | Al | Others | fn1 | fn3 | fn5 |
| G1 | *0.03 | 1.78 | 0.88 | 0.015 | — | 0.006 | — | 0.0122 | 0.022 | — | 9.9 | 38 | 24 |
| G2 | *0.58 | 0.67 | 0.54 | *0.004 | 0.24 | 0.021 | 0.07 | 0.0025 | 0.009 | — | *−4.0 | 83 | 74 |
| G3 | 0.39 | *0.26 | 1.36 | 0.032 | — | 0.016 | 0.05 | 0.0064 | *0.046 | — | *−0.4 | 67 | 52 |
| G4 | 0.38 | *2.65 | 1.27 | 0.008 | — | 0.012 | — | 0.0124 | 0.009 | — | *−3.8 | 90 | 64 |
| G5 | 0.32 | 0.94 | *2.46 | 0.020 | 1.10 | 0.029 | — | 0.0072 | 0.025 | — | *−5.5 | 122 | 104 |
| G6 | 0.36 | 0.86 | 1.12 | 0.025 | *2.28 | *0.052 | — | 0.0061 | 0.020 | — | *−4.2 | 139 | 142 |
| G7 | 0.24 | 1.15 | 0.76 | *0.110 | 1.51 | 0.016 | *0.56 | 0.0055 | 0.009 | — | 6.4 | 102 | 126 |
| G8 | 0.39 | 0.56 | *2.42 | 0.020 | 1.02 | 0.026 | — | *0.0250 | 0.008 | *Ni: 2.25 | *−7.5 | 121 | 104 |
| G9 | 0.35 | 0.76 | 1.12 | 0.024 | 1.25 | 0.016 | 0.17 | 0.0074 | 0.016 | *Mo: 1.86 | *−2.7 | 188 | 135 |
| G10 | 0.45 | 1.14 | 0.89 | 0.016 | 1.56 | 0.007 | — | 0.0046 | 0.029 | *B: 0.012, *Bi: 0.17 | *−3.8 | 123 | 120 |
| G11 | 0.29 | 0.99 | 1.20 | 0.019 | 0.89 | 0.029 | — | 0.0042 | 0.031 | *Pb: 0.26, *Te: 0.06 | 0.8 | 90 | 81 |
| G12 | 0.38 | 0.57 | 1.25 | 0.039 | — | 0.022 | — | 0.0102 | 0.029 | *Cu: 1.88 | 2.5 | 67 | 50 |

fn1 = − 23C + Si(5 − 2Si) − 4Mn + 104S − 3Cr − 9V + 10
fn3 = 100C + 11Si + 18Mn + 32Cr + 45Mo + 6V
fn5 = 87C + 7Si + 10Mn + 41Cr + 15Mo + 50V
(Each element symbol appearing in the above equations represents the content of the corresponding element.)
A value marked with * falls outside the corresponding range specified in the present invention.

TABLE 12

| | Chemical composition (mass %) Balance: Fe and impurities | | | | | | | | | | | | |
|---|---|---|---|---|---|---|---|---|---|---|---|---|---|
| Steel | C | Si | Mn | S | Cr | P | V | N | Al | Others | fn1 | fn3 | fn5 |
| G13 | 0.50 | 0.92 | 1.21 | 0.055 | 0.59 | 0.014 | 0.14 | *0.0170 | 0.022 | *Nb: 0.12 | *−0.7 | 102 | 93 |
| G14 | 0.39 | 0.55 | 0.98 | 0.036 | 0.78 | 0.017 | 0.11 | 0.0035 | 0.020 | *Ti: 0.32 | *−0.3 | 88 | 85 |
| H1 | 0.48 | 1.15 | 0.79 | 0.072 | 0.82 | 0.012 | 0.09 | 0.0145 | 0.032 | — | 3.1 | 102 | 96 |
| H2 | 0.30 | 0.68 | 1.29 | 0.048 | 1.56 | 0.026 | — | 0.0065 | 0.028 | — | 0.7 | 111 | 108 |
| H3 | 0.36 | 0.89 | 1.06 | 0.009 | 0.99 | 0.020 | 0.08 | 0.0119 | 0.019 | — | *−2.4 | 97 | 93 |
| H4 | 0.51 | 0.55 | 1.29 | 0.073 | 0.32 | 0.010 | — | 0.0102 | 0.025 | — | 1.9 | 91 | 74 |
| HS | 0.48 | 0.71 | 1.08 | 0.019 | 1.05 | 0.029 | 0.13 | 0.0067 | 0.031 | — | *−5.2 | 110 | 107 |
| H6 | 0.15 | 2.24 | 1.29 | 0.008 | 1.55 | 0.023 | 0.29 | 0.0059 | 0.016 | — | *−3.9 | 114 | 120 |
| H7 | 0.25 | 0.58 | 1.05 | 0.021 | 1.33 | 0.028 | — | 0.0145 | 0.016 | — | 0.5 | 93 | 91 |
| H8 | 0.40 | 0.58 | 1.45 | 0.021 | 0.21 | 0.028 | — | 0.0087 | 0.016 | — | *−1.2 | 79 | 62 |
| J1 | 0.48 | *0.29 | 1.20 | 0.043 | — | 0.025 | — | 0.0093 | 0.019 | — | *−0.1 | 73 | 56 |

fn1 = − 23C + Si(5 − 2Si) − 4Mn + 104S − 3Cr − 9V + 10
fn3 = 100C + 11Si + 18Mn + 32Cr + 4SMo + 6V
fn5 = 87C + 7Si + 10Mn + 41Cr + 15Mo + 50V
(Each element symbol appearing in the above equations represents the content of the corresponding element.)
A value marked with * falls outside the corresponding range specified in the present invention.

Next, these steel ingots were hot-forged in such a manner as to be heated to a temperature of 1250° C. and then be finished at a temperature of 1000° C. or higher, thereby obtaining round bars, each having a diameter of 60 mm. The hot-forged round bars were air-cooled so as to simulate a process for manufacturing non-heat treatment type steels. After being air-cooled, steels E3, E4, E8, F4, F5, G5, G6, G12, and H4 to H6 were heated to a temperature of 850° C. to 1000° C. according to the chemical compositions of the steels and then normalized or quenched, followed by tempering except for steel H5.

No. 14A test pieces for the tensile test (diameter of a parallel portion: 8 mm) specified in JIS Z 2201 and No. 3 test pieces for the Charpy impact test (2 mm U-notch type) specified in JIS Z 2202 were taken from the thus-obtained round bars such that each of the tensile test pieces and Charpy impact test pieces extends in parallel with a hot-forging direction from the R/2 position of each of the round bars. The steels were tested for tensile characteristics and toughness (absorbed energy: $_UE_{RT}$) at room temperature and toughness at −50° C. (absorbed energy: $_UE_{-50}$) by use of the test pieces.

Hardness test pieces, each having a length of 20 mm, were cut out from the round bars of a 60 mm diameter. Hv hardness was measured at the R/2 position on the thus-obtained section. As in the case of Example 1, Hv hardness was measured at 6 positions of each of the test pieces. The average of the measured values was taken as the Hv hardness of the test piece.

Furthermore, test pieces were taken from the round bars such that each of the test pieces extends in parallel with the hot-forging direction while the R/2 position was located at the center of the test piece. The thus-obtained L-section on each of the test pieces was mirror-like polished. The mirror-like polished surface of each of the test pieces was observed by 60 fields of view through an optical microscope at 400 magnifications so as to examine inclusions. Subsequently, the mirror-like polished surface of each of the test pieces was etched by nital and then observed for microstructure at the R/2 position though the optical microscope at 400 magnifications, thereby measuring the percentage (area percentage) of ferrite and judging the microstructure.

The round bars of a 60 mm diameter were subjected to a drilling test and a turning test under the same conditions as those of Example 1 so as to examine machinability thereof.

Steels G10 and G11 suffered cracking in the course of hot forging. Thus, steels G10 and G11 were subjected only to the above-mentioned observation of microstructure at the R/2 position for measurement of the percentage (area percentage) of ferrite and judgement on microstructure.

Tables 13 to 16 show the results of the above-mentioned tests. As mentioned previously, symbols appearing in the "heat treatment" column of Tables 13 to 16 have the following meaning: N: normalizing; T: tempering; Q: quenching; and -: non-heat-treated. Symbols appearing in the "microstructure" column have the following meaning: F: ferrite; P: pearlite; B: bainite; M: martensite; and a: area percentage of ferrite in microstructure. A parenthesized value in the "heat treatment" column denotes tempering temperature (° C.).

The microstructures of steels G10 and G11 assumed the phases "B+M" and "F+M" and ferrite percentages (α) of 0% and 21%, respectively. Accordingly, when the respective round bars of a 60 mm diameter were manufactured under the previously mentioned conditions, the fn2 value was 3.2 for steel G10 and 4.9 for steel G11.

TABLE 13

| | | | Microstructure | | | | Tensile characteristics | | | | | | | | |
|---|---|---|---|---|---|---|---|---|---|---|---|---|---|---|---|
| Test number | Steel | Heat Treatment | Phase | α (%) | fn2 | fn4 | TS (MPa) | YS (MPa) | YS/TS | Reduction of area (%) | Toughness $_{U}E_{RT}$ (J) | Toughness $_{U}E_{-50}$ (J) | Hv hardness | Drill life (number of drilled holes) | Amount of tool wear on turning (μm) |
| 46 | E1 | — | F + P | 72 | 5.9 | 0.0 | 602 | 467 | 0.78 | 68 | 125 | 60 | 188 | 909 | 25 |
| 47 | E2 | — | F + P | 60 | 5.6 | 0.0 | 733 | 448 | 0.61 | 24 | 106 | 51 | 230 | 531 | 93 |
| 48 | E3 | NT(600) | F + P + B | 28 | 4.1 | 9.1 | 908 | 521 | 0.57 | 26 | 102 | 58 | 287 | 258 | 157 |
| 49 | E4 | NT(600) | F + P + B | 24 | 4.1 | 5.5 | 791 | 436 | 0.55 | 26 | 117 | 45 | 249 | 415 | 140 |
| 50 | E5 | — | F + P | 78 | 5.3 | 0.0 | 751 | 555 | 0.74 | 41 | 125 | 52 | 236 | 201 | 20 |
| 51 | E6 | — | F + P | 55 | 5.4 | 0.0 | 787 | 498 | 0.63 | 20 | 92 | 46 | 248 | 364 | 103 |
| 52 | E7 | — | F + P | 72 | 5.5 | 0.0 | 770 | 425 | 0.55 | 28 | 116 | 51 | 243 | 758 | 114 |
| 53 | E8 | QT(650) | F + M + B | 22 | 3.7 | 0.0 | 812 | 504 | 0.62 | 23 | 119 | 54 | 256 | 161 | 133 |
| 54 | E9 | — | F + P | 63 | 5.9 | 0.0 | 810 | 476 | 0.59 | 28 | 109 | 55 | 256 | 363 | 134 |
| 55 | E10 | — | F + P | 64 | 5.4 | 0.0 | 764 | 561 | 0.73 | 57 | 103 | 53 | 241 | 251 | 15 |
| 56 | F1 | — | F + P | 28 | 4.4 | 5.4 | 652 | 458 | 0.70 | 68 | 62 | 24 | 204 | 749 | 43 |
| 57 | F2 | — | F + P | 61 | 5.2 | 16.0 | 944 | 495 | 0.52 | 28 | 89 | 30 | 299 | 683 | 158 |
| 58 | F3 | — | F + P | 20 | 3.8 | 16.1 | 711 | 424 | 0.60 | 35 | 60 | 24 | 233 | 216 | 129 |

In the "heat treatment" column, the symbol "—" denotes non-heat-treated; "N" normalizing; "T" tempering; and "Q" quenching. A parenthesized value denotes temperature (° C).
In the "microstructure" column, the symbol "F" denotes ferrite; "P" pearlite; "B" bainite; "M" martensite; and "α" area percentage of ferrite.
In the "tensile characteristics" column, the symbol "TS" denotes tensile strength, and "YS" denotes yield strength.

TABLE 14

| | | | Microstructure | | | | Tensile characteristics | | | | | | | | |
|---|---|---|---|---|---|---|---|---|---|---|---|---|---|---|---|
| Test number | Steel | Heat Treatment | Phase | α (%) | fn2 | fn4 | TS (MPa) | YS (MPa) | YS/TS | Reduction of area (%) | Toughness $_{U}E_{RT}$ (J) | Toughness $_{U}E_{-50}$ (J) | Hv hardness | Drill life (number of drilled holes) | Amount of tool wear on turning (μm) |
| 59 | F4 | NT(600) | F + B + M | 15 | 3.6 | 3.5 | 828 | 529 | 0.64 | 27 | 77 | 33 | 233 | 478 | 78 |
| 60 | F5 | QT(650) | F + M | 25 | 4.0 | 0.4 | 878 | 642 | 0.73 | 46 | 80 | 29 | 233 | 278 | 96 |
| 61 | F6 | — | F + P | 27 | 4.5 | 17.8 | 901 | 494 | 0.55 | 30 | 41 | 23 | 285 | 1065 | 68 |
| 62 | F7 | — | F + P | 30 | 4.4 | 10.4 | 654 | 469 | 0.72 | 58 | 48 | 24 | 205 | 548 | 26 |
| 63 | F8 | — | F + P | 56 | 5.5 | 7.5 | 757 | 458 | 0.61 | 26 | 94 | 42 | 238 | 369 | 123 |
| 64 | F9 | — | F + P | 29 | 4.1 | 19.7 | 701 | 427 | 0.61 | 37 | 61 | 30 | 220 | 427 | 95 |
| 65 | F10 | — | F + P | 26 | 4.3 | 19.6 | 957 | 530 | 0.55 | 27 | 43 | 33 | 303 | 249 | 188 |
| 66 | F11 | — | F + P | 18 | 3.6 | 9.6 | 1004 | 628 | 0.63 | 17 | 45 | 23 | 325 | 155 | 112 |
| 67 | F12 | — | F + P | 19 | 3.7 | 9.8 | 776 | 508 | 0.65 | 43 | 47 | 24 | 245 | 208 | 80 |
| 68 | F13 | — | F + P | 33 | 4.5 | 10.3 | 869 | 561 | 0.65 | 24 | 43 | 21 | 275 | 209 | 111 |
| 69 | F14 | — | F + P | 12 | 3.6 | 6.5 | 916 | 598 | 0.65 | 30 | 48 | 18 | 306 | 512 | 7 |
| 70 | F15 | — | F + P | 20 | 3.7 | 8.5 | 777 | 505 | 0.65 | 43 | 54 | 24 | 245 | 218 | 80 |

In the "heat treatment" column, the symbol "—" denotes non-heat-treated; "N" normalizing; "T" tempering; and "Q" quenching. A parenthesized value denotes temperature (° C).
In the "microstructure" column, the symbol "F" denotes ferrite; "P" pearlite; "B" bainite; "M" martensite; and "α" area percentage of ferrite.
In the "tensile characteristics" column, the symbol "TS" denotes tensile strength, and "YS" denotes yield strength.

TABLE 15

| Test number | Steel | Heat Treatment | Micro-structure Phase | α (%) | fn2 | fn4 | Tensile characteristics TS (MPa) | YS (MPa) | YS/TS | Reduction of area (%) | Toughness $_UE_{RT}$ (J) | $_UE_{-50}$ (J) | Hv hard-ness | Drill life (number of drilled holes) | Amount of tool wear on turning (μm) |
|---|---|---|---|---|---|---|---|---|---|---|---|---|---|---|---|
| 71 | F16 | — | F + P | 15 | 2.8 | 7.9 | 744 | 493 | 0.66 | 62 | 43 | 21 | 234 | 175 | 46 |
| 72 | G1 | — | F + P | 95 | 2.7 | 0.0 | 449 | 348 | 0.77 | 51 | 157 | 85 | 138 | 118 | 115 |
| 73 | G2 | — | F + P | 5 | 2.8 | 8.9 | 1017 | 598 | 0.59 | 17 | 64 | 29 | 323 | 15 | 258 |
| 74 | G3 | — | F + P | 40 | 5.3 | 0.0 | 795 | 500 | 0.63 | 24 | 99 | 35 | 251 | 55 | 279 |
| 75 | G4 | — | F + P | 50 | 4.8 | 0.0 | 925 | 616 | 0.67 | 20 | 50 | 29 | 293 | 18 | 266 |
| 76 | G5 | NT(550) | M + B | 0 | 2.8 | 0.0 | 906 | 648 | 0.72 | 26 | 10 | 3 | 287 | 12 | 134 |
| 77 | G6 | QT(600) | M | 0 | 2.6 | 16.8 | 971 | 609 | 0.63 | 31 | 10 | 3 | 308 | 2 | 282 |
| 78 | G7 | — | F + P | 10 | 3.2 | 14.6 | 953 | 624 | 0.66 | 27 | 24 | 2 | 302 | 0 | 46 |
| 79 | G8 | — | B + M | 0 | 0.8 | 0.0 | 950 | 656 | 0.69 | 24 | 36 | 17 | 301 | 0 | 292 |
| 80 | G9 | — | B + M | 0 | 1.9 | 4.5 | 1108 | 789 | 0.71 | 12 | 12 | 3 | 355 | 0 | 345 |
| 81 | G12 | QT(600) | F + B + M | 5 | 1.8 | 0.0 | 782 | 474 | 0.61 | 16 | 26 | 12 | 247 | 25 | 244 |

In the "heat treatment" column, the symbol "—" denotes non-heat-treated; "N" normalizing; "T" tempering; and "Q" quenching. A parenthesized value denotes temperature (° C).
In the "microstructure" column, the symbol "F" denotes ferrite; "P" pearlite; "B" bainite; "M" martensite; and "α" area percentage of ferrite.
In the "tensile characteristics" column, the symbol "TS" denotes tensile strength, and "YS" denotes yield strength.

TABLE 16

| Test number | Steel | Heat Treatment | Micro-structure Phase | α (%) | fn2 | fn4 | Tensile characteristics TS (MPa) | YS (MPa) | YS/TS | Reduction of area (%) | Toughness $_UE_{RT}$ (J) | $_UE_{-50}$ (J) | Hv hard-ness | Drill life (number of drilled holes) | Amount of tool wear on turning (μm) |
|---|---|---|---|---|---|---|---|---|---|---|---|---|---|---|---|
| 82 | G13 | — | F + P | 8 | 2.1 | 2.4 | 1037 | 624 | 0.60 | 18 | 26 | 28 | 329 | 0 | 273 |
| 83 | G14 | — | F + P | 20 | 4.4 | 3.4 | 960 | 609 | 0.63 | 17 | 12 | 5 | 308 | 25 | 249 |
| 84 | H1 | — | F + P | 12 | 2.6 | 12.2 | 1009 | 565 | 0.56 | 12 | 36 | 25 | 320 | 249 | 154 |
| 85 | H2 | — | B + M | 0 | 2.2 | 5.0 | 838 | 520 | 0.62 | 41 | 27 | 12 | 265 | 35 | 134 |
| 86 | H3 | — | F + P | 11 | 2.4 | 1.9 | 883 | 581 | 0.66 | 33 | 43 | 28 | 279 | 0 | 148 |
| 87 | H4 | NT(600) | B + M | 0 | 2.0 | 0.0 | 958 | 528 | 0.55 | 27 | 49 | 21 | 304 | 122 | 202 |
| 88 | H5 | N | B + M | 0 | 2.2 | 7.0 | 1029 | 649 | 0.63 | 24 | 9 | 5 | 327 | 10 | 299 |
| 89 | H6 | QT(550) | F + B | 4 | 2.1 | 0.0 | 870 | 678 | 0.78 | 38 | 5 | 2 | 275 | 73 | 59 |
| 90 | H7 | — | F + P | 9 | 1.8 | 2.9 | 741 | 482 | 0.65 | 41 | 44 | 31 | 233 | 29 | 123 |
| 91 | H8H | — | F + P | 32 | 4.8 | 0.0 | 960 | 609 | 0.63 | 28 | 73 | 33 | 264 | 23 | 249 |
| 92 | J1 | — | F + P | 40 | 5.2 | 0.0 | 873 | 503 | 0.58 | 31 | 28 | 7 | 276 | 94 | 208 |

In the "heat treatment" column, the symbol "—" denotes non-heat-treated; "N" normalizing; "T" tempering; and "Q" quenching. A parenthesized value denotes temperature (° C).
In the "microstructure" column, the symbol "F" denotes ferrite; "P" pearlite; "B" bainite; "M" martensite; and "α" area percentage of ferrite.
In the "tensile characteristics" column, the symbol "TS" denotes tensile strength, and "YS" denotes yield strength.

As shown in Tables 13 to 16, in the case of the steels of test Nos. 46 to 70, which contain component elements such that their amounts fall within the corresponding ranges specified in the present invention and which satisfy the requirements specified in the present invention for the fn1 value, the fn2 value, and the percentage of ferrite in microstructure, in spite of a high Hv hardness of 188 to 325, the steels bring about excellent drill life and exhibits good "chip disposability." Also, the steels exhibit excellent machinability on turning; specifically, a tool wear on turning of less than 200 μm. The steels exhibit an fn3 value of 54 to 99, which meets a required fn3 value of not greater than 100, indicating that they have sufficient toughness; specifically, a $_UE_{RT}$ of not less than 40J. Furthermore, the steels of test Nos. 46 to 68 and 70 exhibit an fn5 value of not greater than 100, indicating that the steels have an $_UE_{-50}$ of not less than 20J; i.e., excellent toughness at low temperature.

Particularly, in the case of the steels of test Nos. 48, 49, 56 to 58, and 61 to 70, which satisfy the requirement for inclusions that the fn4 value be not less than 5.0, an anomalous magnetic particle pattern—a pattern of magnetic particles formed in association with a crack present on or immediately below the surface of a steel—was not observed not only in a magnetic particle testing conducted after hot forging but also in one conducted after surface hardening through carburizing or induction hardening. By contrast, among the steels having an fn4 value of less than 5.0, those of test Nos. 54 and 60 were free of streaks in observation after hot forging, but exhibited an anomalous magnetic particle pattern derived from surface hardening in some cases.

Steels F16 and HI of test Nos. 71 and 84 contain component elements such that their amounts fall within the corresponding ranges specified in the present invention, and satisfy the requirement for the fn1 value specified in the present invention (see Tables 10 and 12); however, the fn2 value falls outside the corresponding range specified in the present invention, indicating that "chip disposability" thereof is relatively low.

In the case of the steels of test Nos. 72 to 83 and 85 to 91, at least any one of the content of a certain component element, the fn1 value, the fn2 value, and the percentage of ferrite in microstructure falls outside the corresponding range specified in the present invention. As a result, the steels exhibit a relatively low Hv hardness of 138, the number of drilled holes less than 150 indicating decreased drill life, or low "chip disposability" or tool wear on turning.

Steel J1 of test No. 92 corresponds to the conventional resulfurized free-cutting steel and is thus such that the Si content falls outside the corresponding range specified in the present invention and such that the fn1 value falls outside the corresponding range specified in the present invention, resulting in decreased drill life; specifically, a number of drilled holes of 94. Furthermore, the amount of tool wear on turning is in excess of 200 $\mu$m.

As mentioned previously, steels G10 and G11 suffered cracking in the course of hot forging. Thus, steels G10 and G11 were subjected only to the microstructure observation for measurement of the percentage of ferrite and judgement on microstructure. Other tests were not conducted on the steels.

Example 4

Various steels having a variable Mn content and a basic chemical composition of 0.15%C–1.0%Si–0.025%S–0.5%Cr–0.01% Al–0.005%N–0.02%P were smelted by use of the 150 kg vacuum smelter.

Next, these steel ingots were hot-forged in such a manner as to be heated to a temperature of 1250° C. and then be finished at a temperature of 1000° C. or higher, thereby obtaining round bars, each having a diameter of 60 mm. The hot-forged round bars were air-cooled so as to simulate a process for manufacturing non-heat treatment type steels.

The thus-obtained round bars of a 60 mm diameter were subjected to a drilling test, in which a hole of a 50 mm depth was drilled diametrally in each of the round bars under the same conditions as those of Example 1.

Figure 3:
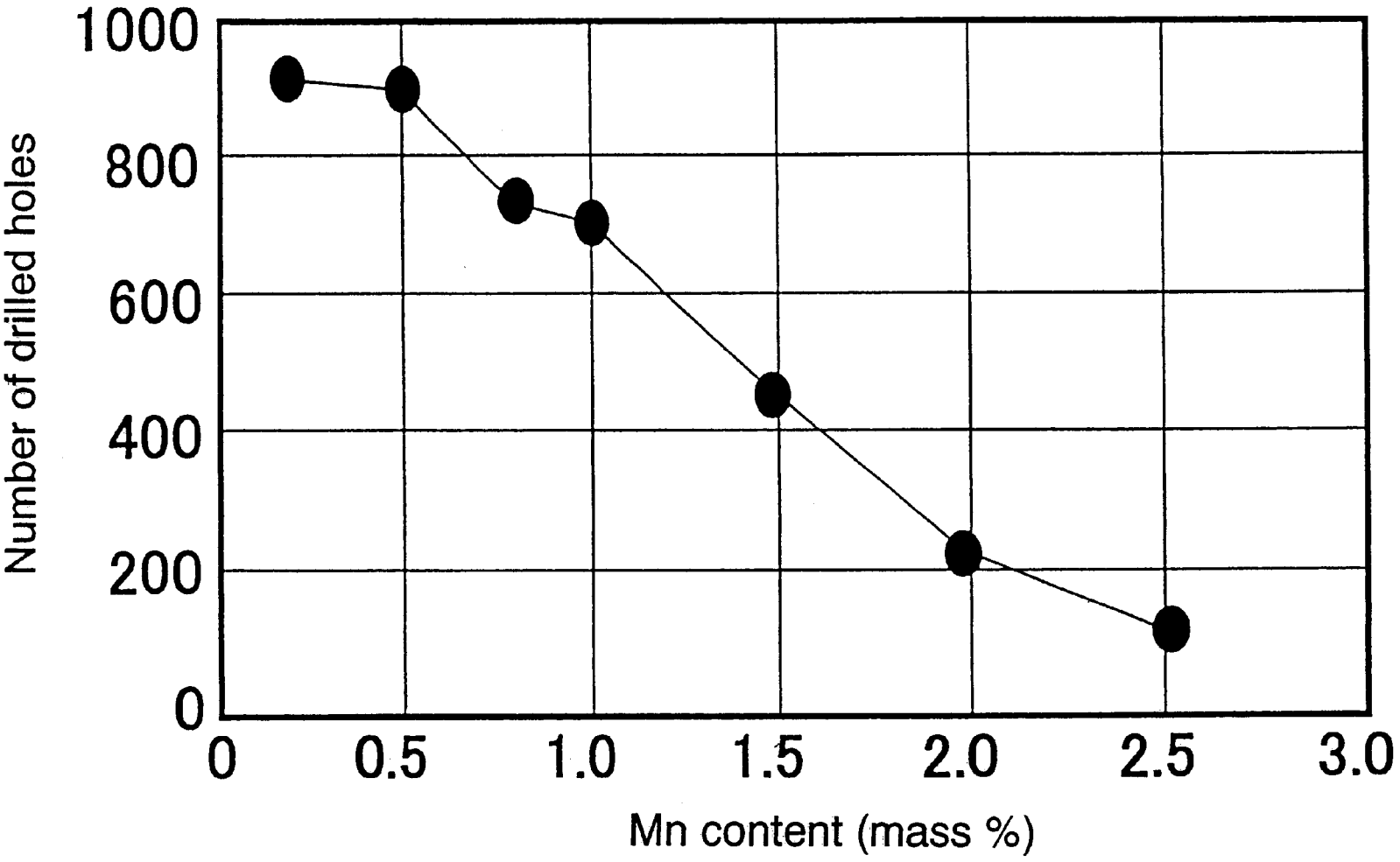
FIG. 3 is a graph showing the relationship between the Mn content on the number of drilled holes indicative of drill life in steels having a basic chemical composition of 0.15% C–1.0%Si–0.02%P–0.025%S–0.5%Cr–0.01%Al–0.005%N, where "%" denotes "mass percent"

FIG. 3 shows the effect of the Mn content on the number of drilled holes indicative of drill life.

As shown in FIG. 3, the lower the Mn content, the greater the number of drilled holes; i.e., machinability improves.

Example 5

Various steels having a variable Mn content and a basic chemical composition of 0.43%C–1.0%Si–0.05%S–0.5%Cr–0.01% Al–0.005%N–0.02%P were smelted by use of the 150 kg vacuum smelter.

Next, these steel ingots were hot-forged in such a manner as to be heated to a temperature of 1250° C. and then be finished at a temperature of 1000° C. or higher, thereby obtaining round bars, each having a diameter of 60 mm. The hot-forged round bars were air-cooled so as to simulate a process for manufacturing non-heat treatment type steels.

The thus-obtained round bars of a 60 mm diameter were examined for inclusions in a manner similar to that of Example 3. Specifically, test pieces were taken from the round bars such that each of the test pieces extends in parallel with the hot-forging direction while the R/2 position was located at the center of the test piece. The thus-obtained L-section on each of the test pieces was mirror-like polished. The mirror-like polished surface of each of the test pieces was observed by 60 fields of view through an optical microscope at 400 magnifications so as to examine inclusions.

Figure 4:
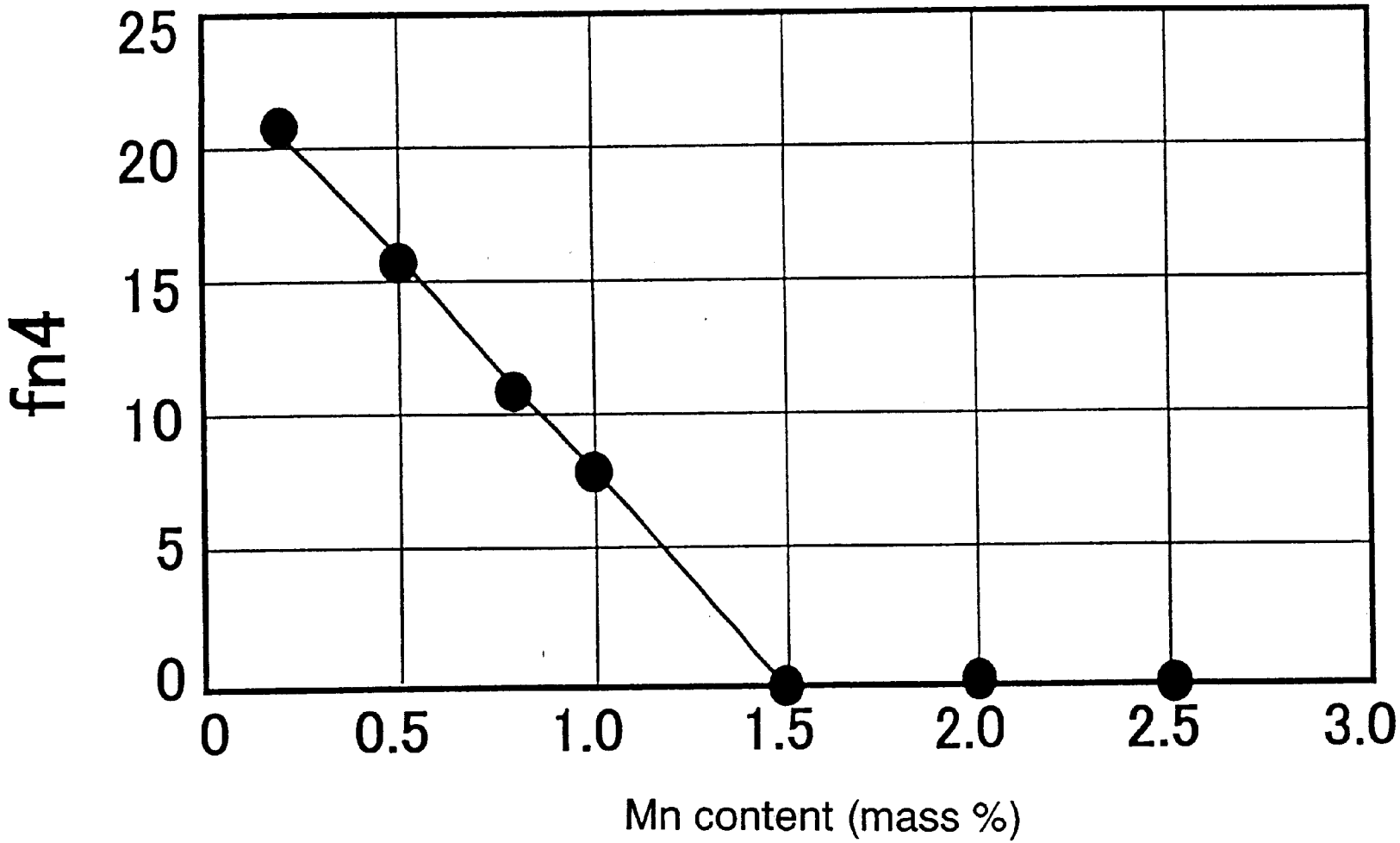
FIG. 4 is a graph showing the relationship between the Mn content and the value of fn4 indicative of fineness of inclusions and represented by equation (4) in steels having a basic chemical composition of 0.43%C–1.0%Si–0.02%P–0.05% S–0.5%Cr–0.01%Al–0.005%N, where "%" denotes "mass percent"

FIG. 4 shows the effect of the Mn content on fining of inclusions.

As shown in FIG. 4, the lower the Mn content, the greater the fn4 value.

Example 6

Various steels having a variable Si content and a basic chemical composition of 0.43%C–0.6%Mn–0.04%S–0.5%Cr–0.01% Al–0.005%N–0.02%P were smelted by use of the 150 kg vacuum smelter.

Next, these steel ingots were hot-forged in such a manner as to be heated to a temperature of 1250° C. and then be finished at a temperature of 1000° C. or higher, thereby obtaining round bars, each having a diameter of 60 mm. The hot-forged round bars were air-cooled so as to simulate a process for manufacturing non-heat treatment type steels.

The thus-obtained round bars of a 60 mm diameter were subjected to a drilling test, in which a hole of a 50 mm depth was drilled diametrally in each of the round bars under the same conditions as those of Example 1. Furthermore, the round bars were subjected to a turning test conducted under the same conditions as those of Example 1.

Figure 5:
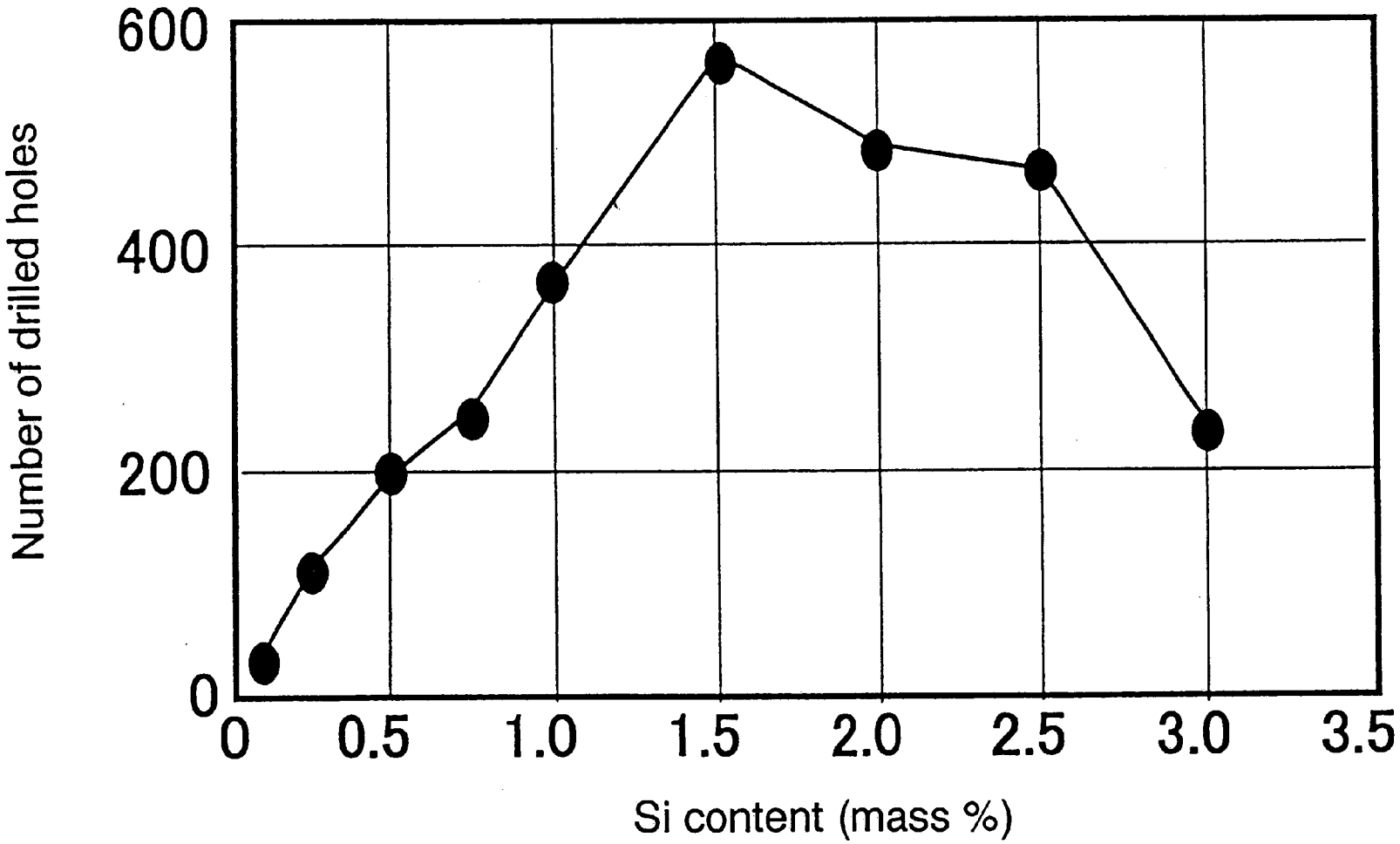
FIG. 5 is a graph showing the relationship between the Si content and the number of drilled holes indicative of drill life in steels having a basic chemical composition of 0.43% C–0.6%Mn–0.02%P–0.04%S–0.5%Cr–0.01%Al–0.005%N, where "%" denotes "mass percent"
Figure 6:
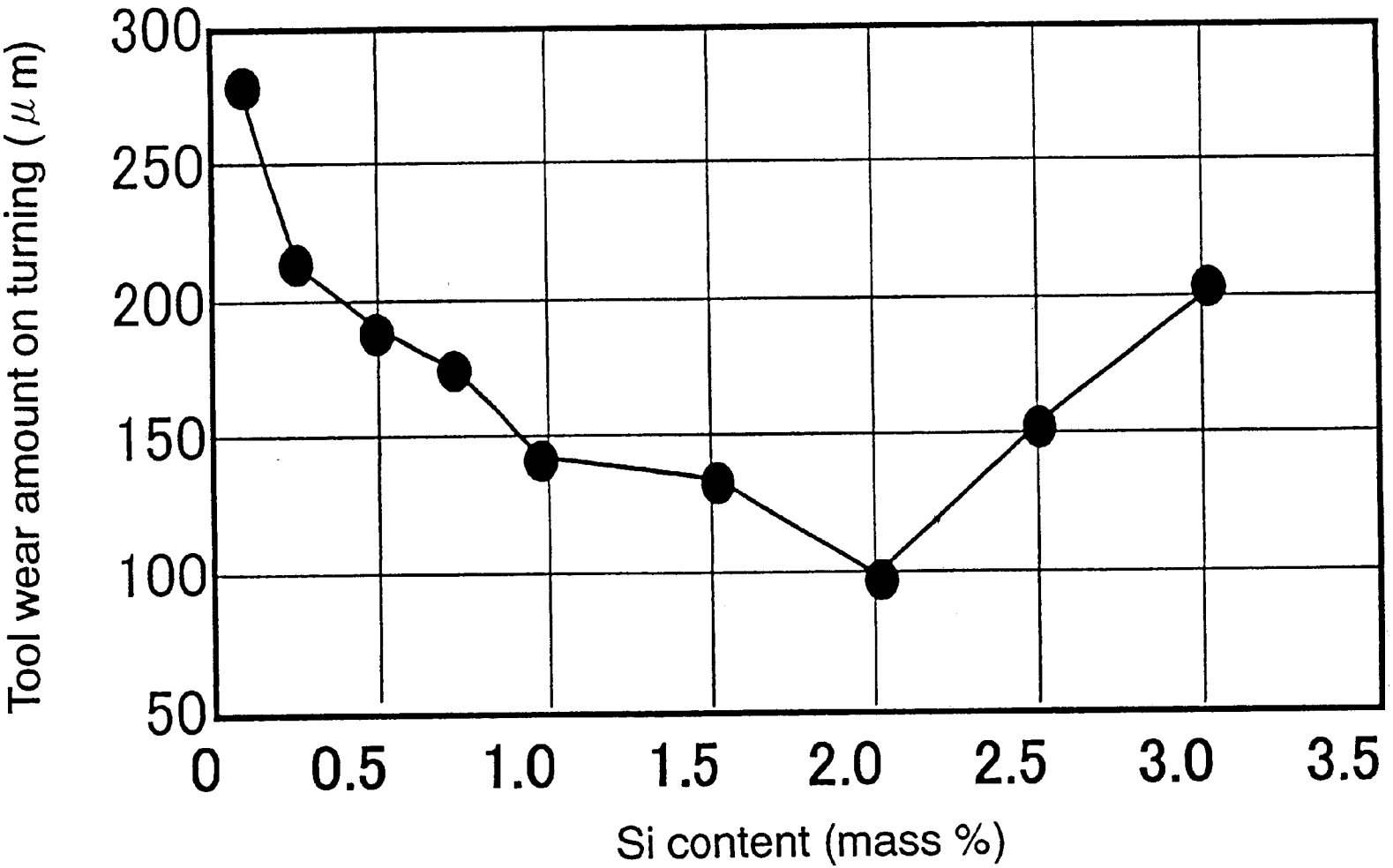
FIG. 6 is a graph showing the relationship between the Si content and the amount of tool wear on turning in steels having a basic chemical composition of 0.43%C–0.6%Mn–0.02% P–0.04%S–0.5%Cr–0.01%Al–0.005%N, where "%" denotes "mass percent."

FIGS. 5 and 6 show the effect of the Si content on the number of drilled holes indicative of drill life and the amount of tool wear on turning.

As shown in FIGS. 5 and 6, in the case of the steels having a basic chemical composition of 0.43%C–0.6%Mn–0.04%S–0.5%Cr–0.01%Al–0.005%N–0.02%P, when the Si content becomes 0.50% or higher, the number of drilled holes exceeds 150, and the amount of tool wear on turning decreases to 200 $\mu$m or less. However, when the Si content exceeds 2.5%, these characteristics deteriorate sharply.

Having excellent machinability and hardness, a steel product for machine structural use of the present invention can be utilized as steel stock for structural steel parts for machinery. Various structural steel parts for machinery can be manufactured relatively easily through machining of the steel product for machine structural use.

What is claimed is:

1. A steel product for machine structural use having a Nd-free chemical composition comprising, in mass percent, C: 0.05% to 0.43%; Si: 0.50% to 2.5%; Mn: 0.15% to 1.06%; P: not greater than 0.035%; S: over 0.080% to 0.2%; Cu: 0% to 1.5%; Ni: 0% to 2.0%; Cr: 0% to 2.0%; Mo: 0% to 1.5%; V: 0% to 0.50%; Nb: 0% to 0.1%; Ti: 0% to less than0.04%; B: 0% to 0.01%; Al: not greater than 0.04%; N: not greater than 0.015%; Bi: 0% to 0.10%; Ca: 0% to 0.05%; Pb: 0% to 0.12%; Te: 0% to 0.05%; Se: 0% to 0.5%; value of fn1 represented by equation (1) below being not less than 7.5; value of fn2 represented by equation (2) below being not less than 3.0; balance being Fe and incidental impurities; an area percentage of a ferrite phase in microstructure being 10% to 80%; and Hv hardness being 160 to 350;

$$fn1=-23C+Si(5-2Si)-4Mn+104S-3Cr-9V+10 \quad (1)$$

$$fn2=3.2C+0.8Mn+5.2S+0.5Cr-120N+2.6Pb+4.1Bi-0.001\alpha^2+0.13\alpha \quad (2)$$

where an element symbol appearing in equation (1) or (2) represents the content in mass percent of the corresponding element, and $\alpha$ represents the area percentage in % of the ferrite phase in the microstructure.

2. A steel product for machine structural use having a Nd-free chemical composition comprising, in mass percent, C: 0.05% to 0.43%; Si: 0.50% to 2.5%; Mn: 0.33% to 1.00%; P: not greater than 0.035%; S: 0.005% to 0.080%; Cu: 0% to 1.5%; Ni: 0% to 2.0%; Cr: 0% to 2.0%; Mo: 0% to 1.5%; V: 0% to 0.50%; Nb: 0% to 0.1%; Ti: 0% to less than 0.04%; B: 0% to 0.01%; Al: 0.010% to 0.04%; N: not greater than 0.015%: Bi: 0% to0.10%; Ca: 0% to0.05%; Pb: 0% to0.12%; Te: 0% to 0.05%; Se: 0% to 0.5%; value of fn1 represented by equation (1) below being not less than 0; value of fn2 represented by equation (2) below being not less than 3.0; value of fn3 represented by equation (3) below being not greater than 100; balance being Fe, incidental impurities and inclusions; an area percentage of a ferrite phase in a microstructure being 10% to 80%; and Hv hardness being 160 to 350;

$$fn1=-23C+Si(5-2Si)-4Mn+104S-3Cr-9V+10 \quad (1)$$

$$fn2=3.2C+0.8Mn+5.2S+0.5Cr-120N+2.6Pb+4.1Bi-0.001\alpha^2+0.1\alpha \quad (2)$$

$$fn3=100C+11Si+18Mn+32Cr+45Mo+6V \quad (3)$$

where an element symbol appearing in equation (1), (2) or (3) represents the content in mass percent of the corresponding element, and $\alpha$ represents the area percentage in % of the ferrite phase in the microstructure.

3. A steel product for machine structural use as described in claim 2, wherein a value of fn4 represented by equation (4) below is not less than 5.0, $$fn4=n_1/n_2 \quad (4)$$

where $n_1$ represents a number of inclusions having a maximum diameter of 0.5$\mu$m to 3 $\mu$m, and $n_2$ represents a number of inclusions having a maximum diameter in excess of 3 $\mu$m as observed in a longitudinal section of the steel product.

4. A steel product for machine structural use as described in claim 2, wherein a value of fn5 represented by equation (5) below is not greater than 100, $$fn5=87C+7Si+10Mn+41Cr+15Mo+50V \quad (5)$$

where an element symbol appearing in equation (5) represents the content in mass percent of the corresponding element.

5. A steel product for machine structural use as described in claim 3, wherein a value of fn5 represented by equation, (5) below is not greater than 100, $$fn5=87C+7Si+10Mn+41Cr+15Mo+50V \quad (5)$$

where an element symbol appearing in equation (5) represents the content in mass percent of the corresponding element.

6. A structural steel part for machinery manufactured from a steel product as described in claim 1.

7. A structural steel part for machinery manufactured from a steel product as described in claim 2.

8. A structural steel part for machinery manufactured from a steel product as described in claim 3.

9. A structural steel part for machinery manufactured from a steel product as described in claim 4.

10. A structural steel part for machinery manufactured from a steel product as described in claim 5.

11. A steel product for machine structural use having a Nd-free chemical composition comprising, in mass percent, C: 0.05% to 0.43%; Si: 0.50% to 2.5%; Mn: 0.15% to 1.06%; P: not greater than 0.035%; S: over 0.080% to 0.2%; Cu: 0% to 1.5%; Ni: 0% to 2.0%; Cr: 0% to 2.0%; Mo: 0% to 1.5%; V: 0% to 0.50%; Nb: 0% to 0.1%; Ti: 0% to less than 0.04%; B: 0% to 0.01%; Al: not greater than 0.04%; N: not greater than 0.015%; Bi: 0% to 0.10%; Ca: 0% to 0.05%; Pb: 0% to 0.12%; Te: 0% to 0.05%; Se: 0% to 0.5%; value of fn1 represented by equation (1) below being not less than 7.5; value of fn2 represented by equation (2) below being not less than 3.0; balance being Fe and incidental impurities; an area percentage of a ferrite phase in a microstructure being 10% to 80%; and Hv hardness being 160 to 350;

$$fn1=-23C+Si(5-2Si)-4Mn+104S-3Cr-9V+10 \quad (1)$$

$$fn2=3.2C+0.8Mn+5.2S+0.5Cr-120N+2.6Pb+4.1Bi-0.001\alpha^2+0.1\alpha \quad (2)$$

where an element symbol appearing in equation (1) or (2) represents the content in mass percent of the corresponding element, and a represents the area percentage in % of the ferrite phase in the microstructure, the balance of the microstructure consisting essentially of pearlite, bainite and martensite.

12. A steel product for machine structural use having a Nd-free chemical composition comprising, in mass percent, C: 0.05% to 0.43%; Si: 0.50% to 2.5%; Mn: 0.33% to 1.00%; P: not greater than 0.035%; S: 0.005% to 0.080%; Cu: 0% to 1.5%; Ni: 0% to 2.0%; Cr: 0% to 2.0%; Mo: 0% to 1.5%; V: 0% to 0.50%; Nb: 0% to 0.1%; Ti: 0% to less than 0.04%; B: 0% to 0.01%; Al: 0.010% to 0.04%; N: not greater than 0.015%: Bi: 0% to 0.10%; Ca: 0% to 0.05%; Pb: 0% to 0.12%; Te: 0% to 0.05%; Se: 0% to 0.5%; value of fn1 represented by equation (1) below being not less than 0; value of fn2 represented by equation (2) below being not less than 3.0; value of fn3 represented by equation (3) below being not greater than 100; balance being Fe, incidental impurities and inclusions; an area percentage of a ferrite phase in a microstructure being 10% to 80%; and Hv hardness being 160 to 350;

$$fn1=-23C+Si(5-2Si)-4Mn+104S-3Cr-9V+10 \quad (1)$$

$$fn2=3.2C+0.8Mn+5.2S+0.5Cr-120N+2.6Pb+4.1Bi-0.001\alpha^2+0.1\alpha \quad (2)$$

$$fn3=100C+11Si+18Mn+32Cr+45Mo+6V \quad (3)$$

where an element symbol appearing in equation (1), (2) or (3) represents the content in mass percent of the corresponding element, and a represents the area percentage in % of the ferrite phase in the microstructure, the balance of the microstructure consisting essentially of pearlite, bainite and martensite.

* * * * *

UNITED STATES PATENT AND TRADEMARK OFFICE

CERTIFICATE OF CORRECTION

PATENT NO. : 6,475,305 B1 
DATED : November 5, 2002
INVENTOR(S) : K. Watari et al.

It is certified that error appears in the above-identified patent and that said Letters Patent is hereby corrected as shown below:

Column 32,
Line 49, the entire line is replaced:
-- fn2 = 3.2C + 0.8Mn + 5.2S + 0.5Cr - 120N + 2.6Pb + 4.1Bi - $0.001\alpha^2$ + 0.13α … (2) --

Column 33,
Line 7, the entire line is replaced:
-- fn2 = 3.2C + 0.8Mn + 5.2S + 0.5Cr - 120N + 2.6Pb + 4.1Bi - $0.001\alpha^2$ + 0.13α … (2) --

Column 34,
Line 16, the entire line is replaced:
-- fn2 = 3.2C + 0.8Mn + 5.2S + 0.5Cr - 120N + 2.6Pb + 4.1Bi - $0.001\alpha^2$ + 0.13α … (2) --
Line 20, "a" is replaced with -- α --.
Line 43, the entire line is replaced:
-- fn2 + 3.2C + 0.8Mn + 5.2S + 0.5Cr - 120N + 2.6Pb + 4.1Bi - $0.001\alpha^2$ + 0.13α … (2) --
Line 49, "a" is replaced with -- α --.

Signed and Sealed this

Twenty-seventh Day of May, 2003

JAMES E. ROGAN
*Director of the United States Patent and Trademark Office*